United States Patent [19]

Itoigawa et al.

[11] Patent Number: 4,932,843

[45] Date of Patent: Jun. 12, 1990

[54] VARIABLE DISPLACEMENT SWASH-PLATE TYPE COMPRESSOR

[75] Inventors: Fumihiro Itoigawa, Nagoya; Mitsuo Inagaki, Okazaki; Shigeki Iwanami, Okazaki; Yoshiki Kurokawa, Okazaki; Akikazu Kojima, Gamagori, all of Japan

[73] Assignees: Nippondenso Co., Ltd., Kariya; Nippon Soken, Inc., Nishio, both of Japan

[21] Appl. No.: 295,762

[22] Filed: Jan. 11, 1989

[30] Foreign Application Priority Data

Jan. 25, 1988 [JP] Japan ..... 63-14201
Mar. 2, 1988 [JP] Japan ..... 63-49230

[51] Int. Cl.[5] ..... F04B 1/26

[52] U.S. Cl. ..... 417/222; 92/12.2; 91/506

[58] Field of Search ..... 417/222, 222 S; 92/12.2; 91/506

[56] References Cited

U.S. PATENT DOCUMENTS 3,861,829 1/1975 Roberts et al. .
3,959,983 6/1976 Roberts et al. ..... 62/226
4,526,516 7/1985 Swain et al. ..... 417/222 S
4,730,986 3/1988 Kayukawa et al. ..... 417/222 S
4,842,488 6/1989 Terauchi ..... 417/222 S
4,886,423 12/1989 Iwanami ..... 417/222

FOREIGN PATENT DOCUMENTS 255764 2/1988 European Pat. Off. ..... 417/222 S
58-162780 9/1983 Japan .
58-162781 9/1983 Japan .
58-162782 9/1983 Japan .
58-162783 9/1983 Japan .
55380 3/1986 Japan ..... 417/222 S
150478 6/1988 Japan ..... 417/222
150479 6/1988 Japan ..... 417/222

*Primary Examiner*—Leonard E. Smith
*Attorney, Agent, or Firm*—Cushman, Darby & Cushman

[57] ABSTRACT

A variable displacement swash-plate type compressor has a swash plate rockably carried by a shaft, and a spool for changing the angle of tilt of the swash plate and also the position of the center of the swash plate, thereby to vary the displacement of the compressor. The compressor has a control valve which determines a control pressure to be supplied to a control pressure chamber behind the spool, between the level of a low-pressure introduced from a low-pressure side of the compressor and a high-pressure introduced from a high-pressure side of the compressor.

17 Claims, 24 Drawing Sheets

VARIABLE DISPLACEMENT SWASH-PLATE TYPE COMPRESSOR

BACKGROUND OF THE INVENTION

1. FIELD OF THE INVENTION

The present invention relates to an art for controlling displacement of a swash-plate type compressor which is suitable for use as a refrigerant compressor of an automotive air conditioner, for example.

2. DESCRIPTION OF THE PRIOR ART

The present inventors have proposed a variable displacement swash-plate type compressor having a tiltable swash plate mounted on a shaft and arranged such that the tilting angle of the swash plate is varied in accordance with the displacement of a spool and that the position of the center of the swash plate is also controllable.

In this compressor, the tilting angle of the swash plate and the position of the center of the swash plate are both simultaneously controlled in accordance with the movement of a spool effected by a control of the pressure in a control pressure chamber which is formed behind the spool.

The present invention pertains to an improvement in the variable displacement swash-plate type compressor proposed by the present inventors. More particularly, the invention is concerned with an improvement in the control valve for adjusting the control pressure which is introduced into the control pressure chamber.

The suction pressure in this type of compressor varies according to the load applied to the refrigeration cycle, and the control valve operates in such a manner as to control the signal pressure introduced into the control chamber behind the spool in accordance with the change in the suction pressure.

Thus, the position of the spool is changed to increase or decrease the displacement of the compressor in accordance with the change in the suction pressure. In consequence, the displacement of the compressor is controlled in such a manner as to maintain the suction pressure at a constant level. The constant suction pressure of the refrigerator compressor means that the evaporation temperature of the refrigerant in the evaporator of the refrigeration cycle is held constant.

In some cases, however, a better result is obtained when the control is effected to positively vary the evaporation temperature than when the control is made to maintain a constant evaporation temperature, as in the case of a drastic change in the thermal load applied to the refrigeration cycle.

Accordingly, an object of the present invention is to provide a variable displacement swash plate type compressor in which the amount of movement of the spool is controlled basically in accordance with the change in the suction pressure of the controller and also in accordance with a signal other than the suction pressure of the compressor.

SUMMARY OF THE INVENTION

To this end, the variable displacement swashplate type compressor of the present invention has a control valve which controls the signal pressure introduced in to the control pressure chamber formed behind a spool. The control valve has a control valve member for controlling the signal pressure between the level of a low pressure introduced through a low-pressure introduction passage and a high pressure introduced through a high-pressure introduction passage, and a diaphragm-type actuator which deflects in accordance with a change in the suction-side pressure of the compressor so as to actuate the valve member. The amount of deflection of the diaphragm is controllable also by a magnetic force produced by a solenoid-type actuator disposed behind the diaphragm. In consequence, the displacement of the compressor is linearly changed by the movement of the spool which is controlled by the signal pressure produced by the control valve in accordance with the change in the suction-side pressure of the compressor. Therefore, the compressor of the invention is controlled basically in such a manner as to maintain the suction-side pressure of the compressor at a constant level thereby maintaining a constant evaporation temperature of the refrigerant in the evaporator of the refrigeration cycle. In addition, the solenoid-type actuator selectively applies a load so as to vary the urging force acting on the control valve member in the control valve, thereby to allow a change in the suction-side pressure of the compressor which is the command value of the control system. Thus, the variable displacement swash-plate type compressor of the present invention can perform a control for maintaining a constant suction-side pressure and, as desired, a control for linearly changing the evaporation temperature in the evaporator.

These and other objects, features and advantages of the present invention will become more apparent from the following description of preferred embodiments with reference to the accompanying drawings.

DESCRIPTION OF THE PREFERRED EMBODIMENTS

Preferred embodiments of the present invention will be described hereinunder with reference to the accompanying drawings.

Figure 1:
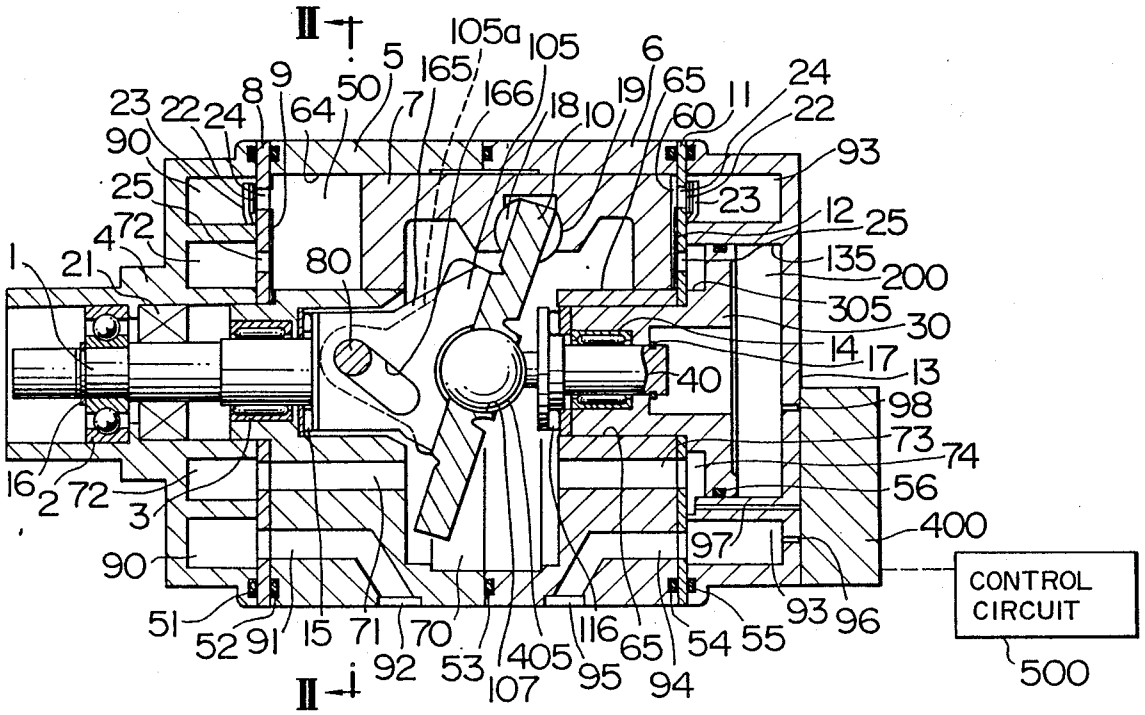
FIG. 1 is a sectional view of an embodiment of a variable displacement swash-plate type compressor in accordance with the present invention.

FIG. 1 is a longitudinal sectional view of a variable displacement swash-plate type compressor embodying the present invention.

The compressor has a front housing 4, a front side plate 8, a suction valve 9, a front cylinder block 5, a rear cylinder block 6, a suction valve 12, a rear side plate 11 and a rear housing 13. These parts are made of an aluminum alloy and assembled together by means of through bolts (not shown) so as to form an outer shell of the compressor. As will be seen from FIG. 2, each of the cylinder blocks 5 and 6 has five cylinders 641 to 645 (collectively denoted by 64 in FIG. 1) which extend in parallel with each other. A shaft 1 which is rotatingly driven by an automotive engine (not shown) is rotatably supported by the front housing 4 and the front cylinder block 5 through bearings 2 and 3, respectively. When the compressor operates, an axial thrust is generated to urge the shaft 1 leftward as viewed in FIG. 1. This thrust is borne by the front cylinder block 5 through a thrust bearing 15, while the movement of the shaft 1 to the right as viewed in FIG. 1 is prevented by means of a stop ring 16 which is received in an annular groove formed in the shaft 1.

A rear shaft 40 is rotatably supported on a spool 30 through a bearing 14. A thrust force acting on the rear shaft 40 rightwards as viewed in FIG. 1 is borne by the spool 30 through a thrust bearing 116. The rear shaft 40 is prevented from coming off the spool 30 by means of a stop ring 17 which is received in an annular groove formed in the rear shaft 40. The spool 30 is axially slidably received in cylindrical portions 65 and 135 which are formed on the rear cylinder block 6 and the rear housing 13, respectively.

A spherical portion 107 is formed in the center of a swash plate 10. A spherical support member 405 is fixed to one end of the rear shaft 40 to receive the spherical portion 107 so that the swash plate 10 is tiltably and rockably supported by the spherical support member 405.

A slit 105 is defined between a pair of flat tabs 105*a* formed on the side surface of the swash plate 10 adjacent to the shaft 1, while a web 165 is formed on the end surface of the shaft 1 adjacent to the swash plate 10. The web 165 is held in face-to-face sliding contact with the inner surfaces of the slit 105 so as to transmit the torque of the shaft 1 to the swash plate 10.

Shoes 18 and 19 are slidably arranged on both sides of the swash plate 10. Pistons 7 are slidably received in the cylinders 64 formed in the front cylinder block 5 and in the cylinders 64 formed in the rear cylinder block 6. As described above, the shoes 18 and 19 are slidable relative to the swash plate 10 and rotatably engage with the inner surfaces of the piston 7. The rocking motion of the rotating swash plate 10 is transmitted to the pistons 7 through the shoes 18 and 19 so as to cause reciprocatory motions of these pistons 7. The shoes 18 and 19 are arranged such that, when they are assembled with the swash plate 10, the outer surfaces of the shoes 18 and 19 extend along a spherical plane.

An elongated slot 166 is formed in the web 165 of the shaft 1, while a pin-receiving hole is formed in each of the flat tabs 105*a* of the swash plate 10. In the assembling operation, the web 165 of the shaft 1 is received in the slit 105 and then a pin 80 is inserted into the pin-receiving holes in the flat tabs 105*a* through the elongated slot 166. The pin 80 is movable within the elongated slot 166 so as to allow the tilting angle of the swash plate 10 to be varied. A change in the tilting angle of the swash plate causes a change in the position of the center of the swash plate (spherical support member 405 for supporting the spherical portion 107). The elongated slot 166 is arranged such that the position of the top dead center of the piston 7 in a second working chamber 60 on the right side of the compressor as viewed in FIG. 1 is not substantially changed, even though the stroke of the piston 7 is changed as a result of a change in the tilting angle of the swash plate 10, so that dead volume in the second working chamber 60 is not substantially changed. On the other hand, in the working chamber 50 which is in the left part of the compressor as viewed in FIG. 1, the top dead center of the piston 7 is significantly changed as a result of the change in the tilting angle of the swash plate, so that the dead volume in this working chamber 50 is changed.

In the described embodiment of the present invention, the elongated slot 166 is so shaped as to prevent any substantial change in the position of the top dead center of the piston 7 in the working chamber 60 despite a change in the angle of tilt of the swash plate 10. Actually, therefore, the elongated slot 166 has a substantially curvilinear form but this form can materially be approximated by a straight one. In the described embodiment, the elongated slot 166 is disposed on the axis of the shaft 1 so that the size of the web 165 is not substantially increased despite the provision of the elongated slot 166 therein. Thus, in the described embodiment, the elongated slot 166 is formed on the axis of the shaft 1 so as to enable the size of the web 165 to be reduced. This arrangement offers a great advantage particularly when used in swash-plate type compressors of the type having the web 165 disposed radially inwardly of the pistons 7.

A shaft seal device denoted by numeral 21 is capable of preventing refrigerant gas and lubricating oil from leaking outside along the surface of the shaft 1. The first and second working chambers 50 and 60 are communicated with respective discharge chambers 90 and 93 through left and right discharge ports 24 which are opened and closed in a controlled manner by means of discharge valves 22. These discharge valves 22 are fixed together with valve retainers 23 to the front side plate 8 and the rear side plate 11 by means of bolts which are not shown. The first and second working chambers 50 and 60 are also communicated with respective suction chambers 72 and 74 through left and right suction ports 25 which are opened and closed in a controlled manner by means of suction valves 9 and 12.

A control valve 400 operates under the control of a control circuit 500 so as to control the internal pressure of a control pressure chamber 200.

Figure 3:
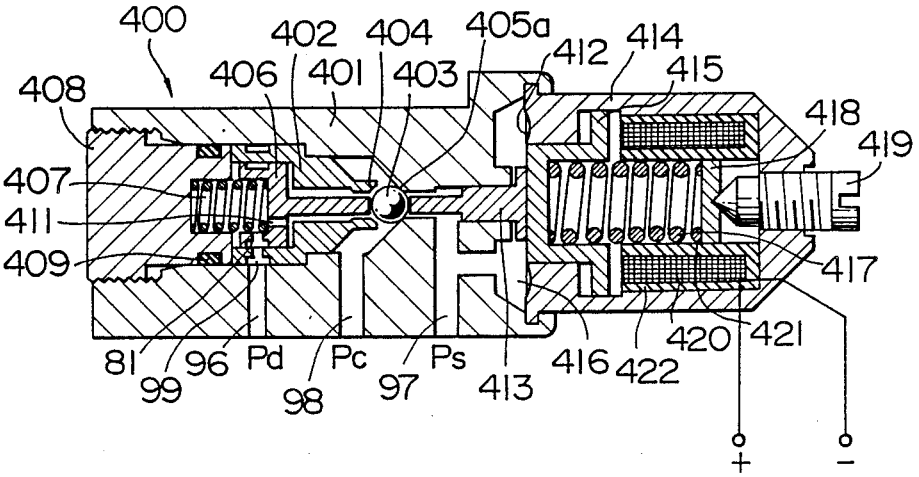
FIG. 3 is a sectional view of a control valve incorporated in the embodiment shown in FIG. 1.

Referring to FIG. 3 which shows the details of the control valve 400, a control valve housing 401 is secured to the rear side of the rear housing 13. A high-pressure introduction passage 96 communicating with the discharge chamber 93, a low-pressure introduction passage 97 communicating with the suction chamber 74 and a signal pressure passage 98 leading to the control pressure chamber 200 are formed in the control valve housing 401. A valve seat member 402 is mounted in the control valve housing 401. A control valve member 403 is disposed to oppose the valve seat member 402. The valve seat member 402 is interposed between the signal pressure passage 98 and the high-pressure introduction passage 96. When the control valve member 403 is seated on a first seat surface 404 of the valve seat member 402, the communication between the signal pressure passage 98 and the high-pressure introduction passage 96 is interrupted. A second seat surface 405*a* is formed on the valve housing 401. The control valve member 403, when seated on the second seat surface 405*a*, interrupts the communication between the signal pressure passage 98 and the low-pressure introduction passage 97.

A retainer member 406 is slidably received in the valve seat member 402 and urged by a support spring 407 so as to be always held in contact with the control valve member 403 to retain the same. The support spring 407 contacts at its one end with the retainer member 46 while the other end thereof is retained on an adjust screw 408 which is screwed into a threaded hole formed in the control valve housing 401. Any clearance between the adjust screw 408 and the control valve housing 401 is sealed by means of an "O" ring 409.

A passage 411 communicating with the highpressure introduction passage 96 is formed in the retainer member 46 and also in the valve seat member 402. Restricting orifices 99 and 81 are provided in the passage 411.

A diaphragm 412 is provided on the side of the control valve member 403 adjacent to the second valve seat surface 405. The deflection of the diaphragm 412 is transmitted to the control valve member 403 through a connecting member 413. The diaphragm 412 is clamped at its peripheral portion between the control valve housing 401 and a solenoid housing 414. The central portion of the diaphragm 412 is clamped between the connecting member 413 and a spool 415. A suction pressure chamber 416 formed on one side of the diaphragm 412 is communicated with the suction chamber 74 through the low-pressure introduction passage 97 so that the suction pressure in the suction chamber 74 is transmitted to the suction pressure chamber 416.

A bias spring 417 is provided on the rear side of the spool 415. The arrangement is such that the connecting portion 413 is moved to the left and right as viewed in FIG. 3 in accordance with the balance between the force produced by the bias spring 417 and the force produced due to a pressure differential across the diaphragm 412. The bias spring 417 is retained by a spring retainer 418 the position of which is adjustable by means of an adjust screw 419.

The bias spring 417 is surrounded by a coil 420 which is formed on a cylindrical member 421 made of a magnetic material, and a yoke member 422 is arranged around the coil 420. The above-mentioned spool 415 is made of a magnetic material and has an end surface which opposes the end surfaces of the cylindrical member 421 and the yoke 422. Therefore, when the coil 420 is excited, a magnetic circuit is formed by the cylindrical member 421, the spool 415 and the yoke 422 so that a magnetic force is produced to urge the spool 415 to the right as viewed in FIG. 3.

Figure 4A:
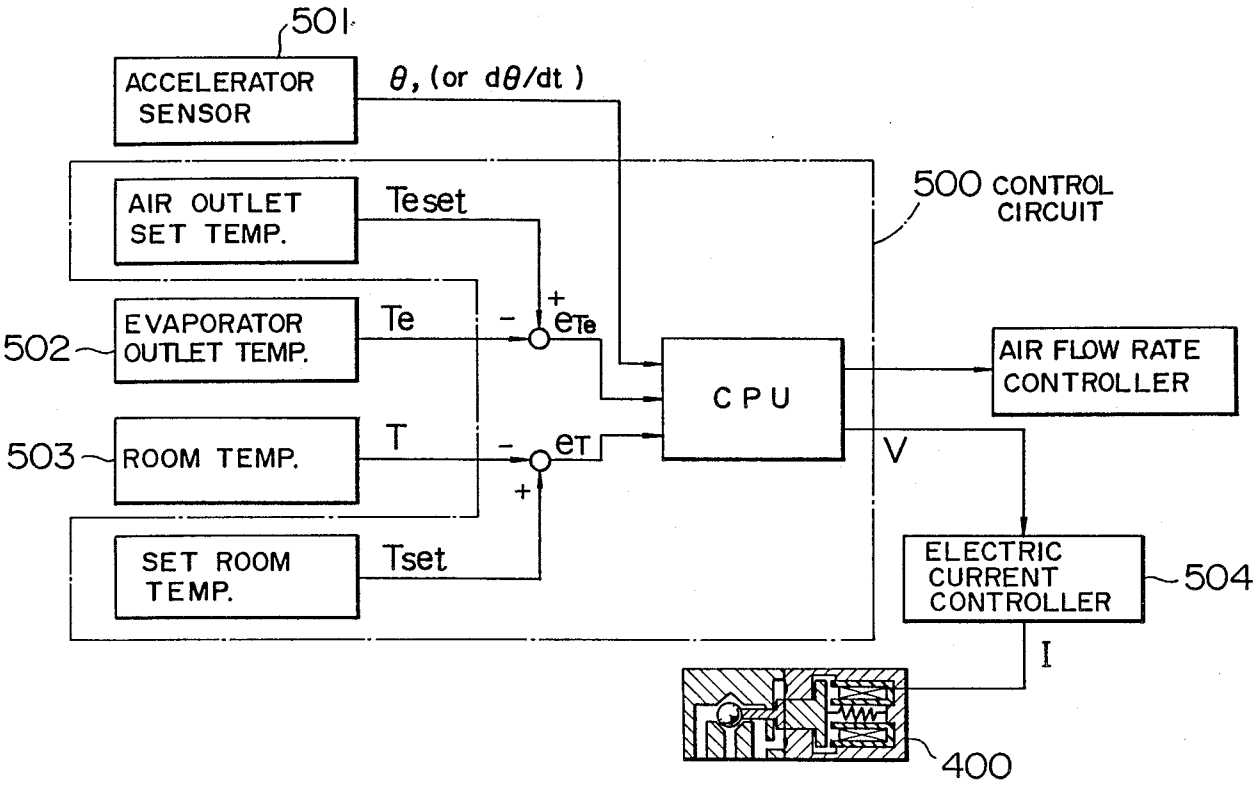
FIG. 4A is a block diagram of a control circuit of the embodiment shown in FIG. 1.

As will be seen from FIG. 4A, the control circuit 500 is capable of producing an output voltage which is controlled in accordance with signals derived from sensors such as an accelerator sensor 501, an evaporator air outlet temperature sensor 502 and a room temperature sensor 503. The output voltage from a central processing unit (CPU) of the control circuit 500 is delivered to a current control means 504 and converted into a signal current I which is supplied to the control valve 400.

The discharge chamber 90 on the front side as viewed in FIG. 1 is connected to a discharge port 92 through a discharge passage 91 which is formed in the cylinder block 5. Similarly, the discharge chamber 93 on the rear side is connected to a discharge port 95 through a discharge passage 94 which is formed in the cylinder block 6. The discharge ports 92 and 95 are connected to each other through an external piping, so that pressures in the discharge chambers 90 and 93 are equalized. The suction chamber 72 on the front side is connected through the suction passage 71 to a suction chamber 70 which is formed in the center of the housing. Similarly, the suction chamber 74 on the rear side is connected to the suction chamber 70 through the suction passage 73. Numerals 51, 52, 53, 54, 55 and 56 denote "O" rings.

The operation of the variable displacement swash-plate type compressor having the described construction is as follows:

When an electromagnetic clutch (not shown) is energized, power is transmitted to the shaft 1 from an automotive engine (not shown) so that the compressor is started.

At the time of start up of the compressor, balance of pressure is maintained between the suction side and the discharge side of the compressor so that the pressure differential across the spool 30 is zero. Thus, there is no load which would act to tilt the swash plate 10 through the support portion 107 when the compressor is started.

As the shaft 1 starts to rotate, pistons 7 are reciprocatingly driven through the swash plate 10 so that suction, compression and discharge of the refrigerant gas are performed in the respective working chambers 50 and 60.

In this state, however, the swash plate 10 receives, through the pistons 7 and the shoes 18, 19, a force which is generated by the difference in the pressure between the second working chambers 60 on the rear side of the compressor and the first working chambers 50 on the front side of the compressor. Since the swash plate 10 is rockably supported by the spherical support member 405 and since the swash plate 10 receives the torque of the shaft through the engagement between the web 165 on the shaft 1 and the flat tabs 105*a* defining the slit 105 receiving the web 165, the force acting on the pistons 7 produces a moment which tends to reduce the angle of tilt of the swash plate 10.

Figure 2:
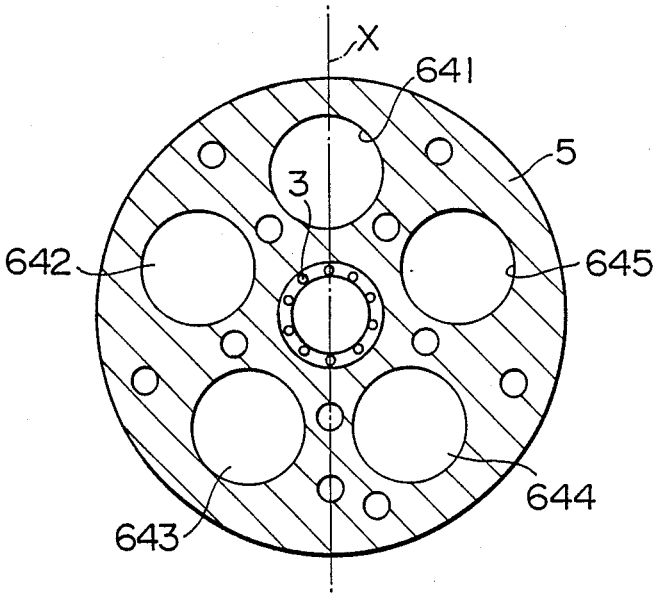
FIG. 2 is a sectional view taken along the line II—II in FIG. 1.

For instance, if the pin 80 is located on a diametrical line X shown in FIG. 2, the piston 7 in the first cylinder 641 does not produce any moment which would serve to change the angle of tilt of the swash plate 10. However, the pistons 7 in the second to fifth cylinders 642, 643, 644 and 645 produce a moment which serves to reduce the angle of tilt of the swash plate 10. The moment, expressed by $Fi \times Ri$ is borne by the counter moment, $Fpm \times R$, which is produced about the pin 80. At the same time, the moment produced by these pistons 7 produce a pressing force FBx which acts on the spherical support member 405.

Figure 6:
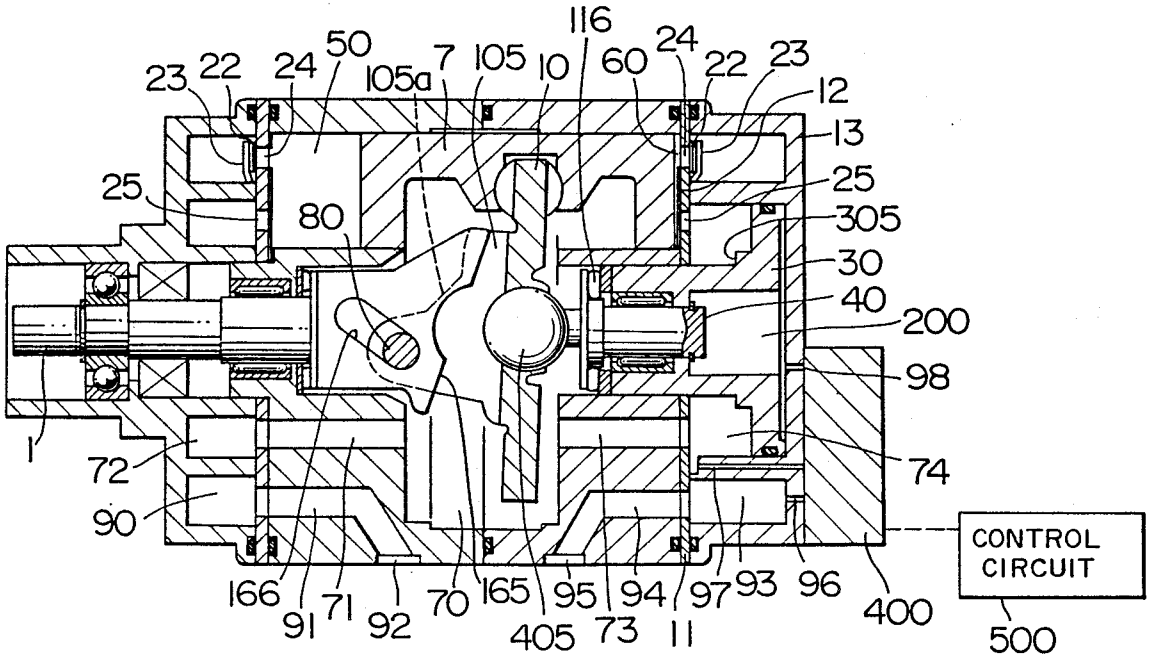
FIG. 6 is a sectional view of the embodiment of FIG. 1 after a change in the state of operation thereof.

In the state in which the suction pressure is introduced into the control pressure chamber 200 via the control valve, the spherical support member 405 and the spool 30 are moved to the right as viewed in FIG. 6, so that the angle of tilt of the swash plate 10 is decreased. Since the swash plate 10 is retained by the pin 80 which is caught in the elongated slot 166 formed in the web 165 of the shaft 1, the rightward movement of the spool 30 causes not only a reduction in the tilting angle of the swash plate 10 but also a rightward movement of the spherical support member 405 which is located on the center of the swash plate 10. The rightward force which acts on the rear shaft 40 through the spherical support member 405 is transmitted to the spool 30 through the thrust bearing 116, so that the spool 30 is moved until it is brought into contact with the bottom of the rear housing 13. The compressor in this state is shown in FIG. 6. The minimum displacement of the compressor is obtained in this state.

A refrigerant gas from a suction port which is not shown but connected to an evaporator of the refrigeration cycle known per se is introduced into the central suction chamber 70 and is then sucked into the front and rear suction chambers 72 and 74 through the suction passages 71 and 73. The refrigerant is then sucked into the working chambers 50 and 60 through the suction ports 25 past the suction valves 12 when the pistons 7 perform their suction strokes. The refrigerant gas sucked into the working chambers are then compressed in the compression strokes of the pistons and, when the pressure of the compressed gas has reached a predetermined level, the gas and forcibly opens the discharge valve 22 is discharged into the discharge chambers 90 and 93 through the discharge ports 24. The refrigerant gas thus compressed to a high pressure is then discharged through the discharge ports 92 and 95 to a condenser (not shown) of the refrigeration cycle.

The first working chambers 50 on the front side of the compressor have a greater dead space than the second working chamber 60 on the rear side, so that the pressure of the refrigerant gas discharged from the first working chambers 50 is lower than the pressure in the discharge chamber 90 into which the compressed gas is discharged from the second working chambers 60. In consequence, the suction and discharge are not performed in the first working chambers 50 on the front side of the compressor.

Thus, the displacement of the compressor is minimized when the compressor is started. However, when a greater displacement of the compressor is demanded by the refrigeration cycle, the pressure of the high-pressure side is introduced into the control pressure chamber 200. It is known that the load demanded for the compressor, i.e., the load on the refrigeration cycle, affects the pressure in the suction side of the compressor. When a large cooling load is imposed, the degree of superheating of the refrigerant in the evaporator is increased, so that the refrigerant pressure is increased at the suction side of the compressor. Conversely, when the cooling load is small, the refrigerant pressure at the suction side of the compressor is decreased. Thus, when the demand for the greater displacement takes place, an increase in the suction pressure of the compressor occurs and this increased suction pressure is introduced into the suction pressure chamber 416 through the low-pressure introduction passage 97. As a result, a greater pressure force is applied to the diaphragm 412, so that the spool 415 is urged to the right as viewed in FIG. 3 overcoming the force of the bias spring 417. This movement of the spool 415 causes the connecting member 413 to be moved to the right as viewed in FIG. 3. In consequence, the control valve member 403 is urged by the retainer member 406 into contact with the second valve seat surface 405*a*, so that the communication between the low-pressure introduction passage 97 and the signal pressure passage 98 is interrupted.

The rightward movement of the control valve member 403 causes the valve port in the first valve seat surface 404 to open, whereby a communication is established between the high-pressure introduction passage 96 and the signal pressure passage 98. Consequently, the pressure in the control pressure chamber 200 is also increased.

As a result, the force produced by the pressure differential between the control pressure chamber 200 and the suction chamber 74 and serving to urge the spool 30 to the left as viewed in FIG. 6 is progressively increased. As this force grows to a level great enough to exceed the rightward urging force acting on the spherical support member 405, the spool 30 starts to move to the left as viewed in FIG. 6. In consequence, the center of rotation of the swash plate 10, i.e., the spherical support member 405, is progressively moved to the left and, simultaneously, the angle of tilt of the swash plate 10 is progressively increased. A further rise of the pressure inside the control pressure chamber 200 causes the spool 30 to further move to the left until a shoulder 305 of the spool 30 is brought into contact with the rear side plate 11, thus realizing the state of the maximum displacement. The compressor in this state is shown in FIG. 1. When the compressor operates in the state shown in FIG. 1, the refrigerant gas sucked through the suction port (not shown) is introduced into the central suction chamber 70 and is introduced into the suction chambers 72 and 74 through the suction passages 71 and 73. The refrigerant is thus sucked through the suction ports 25 via the suction valves 9 and 12 into the working chambers 50 and 60 in which the pistons 7 are in their suction phase. The refrigerant is then compressed when the working chambers 50 and 60 are turned into compression phase and discharged into the discharge chambers 90 and 93 through the discharge ports 24 by forcibly opening the discharge valves 22. The refrigerant is then discharged from the discharge ports 92 and 95 through the discharge passages 91 and 94 so that the flow of the refrigerant from the discharge port 92 and the flow of the refrigerant from the discharge port 94 merge each other in the external piping. In this state, both the working chambers 50 and 60 take part in the suction and discharge of the refrigerant.

Figure 7:
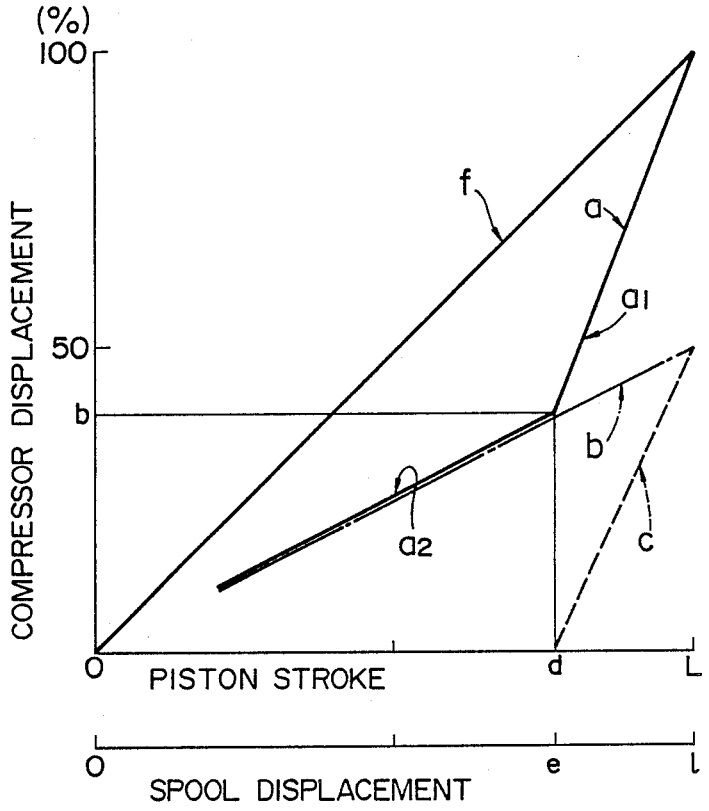
FIG. 7 is an illustration of the relationship between the amount of movement of a spool and a change in the displacement of the compressor of FIG. 1.

Referring to FIG. 7, a solid-line curve a shows the relationship between the piston stroke and the displacement of the variable displacement swash-plate type compressor of the invention. In the variable displacement swash-plate type compressor of the pressent invention, the control of the displacement is effected through a combination of the control of the stroke of the pistons 7 by changing the tilting angle of the swash plate 10 and the control of the position of the center of the swash plate 10, so that the second working chambers 60 on the rear side of the compressor do not experience any substantial increase in the dead volumes. In consequence, the displacement of the compressor progressively decreases in accordance with a decrease of the piston stroke, as will be seen from one-dot-and-dash line b. In contrast, in the first working chambers 50 on the front side of the compressor, the dead volumes are significantly increased as the piston stroke decreases. The increase in the dead volume causes the compression ratio to be reduced with the result that the displacement is sharply reduced as shown by a broken line curve c in FIG. 7. The contribution of the front-side working chambers 50 to the suction and discharge of the refrigerant is ceased when the maximum discharge pressure of the front-side working chambers 50 has come down below the discharge pressure of the rear-side working chambers 60. In this state, only the rear-side working chambers 60 take part in the compression and discharge of the refrigerant. The piston stroke d at which the contribution of the first working chambers 50 is terminated can be determined as follows:

In general, the following relationship exists:

$$Ps\cdot(\pi R^2 L)^k = Pd\cdot\{\pi R^2\cdot(L-d)\}^k$$

Where L represents the maximum piston stroke, Ps represents the suction pressure (kg/cm$^2$·abs), Pd represents the discharge pressure (kg/cm$^2$·abs), k represents the adiabatic constant of the refrigerant gas, R represents piston radius, and x represents the circumference-to-diameter ratio.

$$d = L\cdot\left\{1-\left(\frac{Ps}{Pd}\right)^{1/k}\right\}$$

The displacement b can also be determined as follows:

$$b = \frac{1}{2}\cdot\frac{d}{L}\cdot 100\ (\%)$$

It is assumed here that the suction pressure Ps is 3 kg/cm$^2$·abs, the delivery pressure Pd is 16 kg/cm$^2$·abs and the adiabatic constant k is 1.14, the piston stroke d and the displacement b are respectively calculated as follows:

$$d=0.77L$$

$$b=38.5(\%)$$

The piston stroke is almost proportional to the amount of the displacement of the spool 30. The state in which the spool 30 has been fully displaced to the right as viewed in FIG. 1 is represented by 0 in FIG. 7, while the state in which the spool has been fully displaced to the left as viewed in FIG. 1 is represented by l in FIG. 7. Thus, the relationship between the amount of displacement of the spool and the displacement of the compressor can be represented as shown in FIG. 7 ($L \propto l$).

Thus, the displacement of the compressor of the present invention varies along the solid line a in FIG. 7. In the spool displacement region between l and e, the compressor displacement actually varies as shown by a solid-line curve $a_1$. Thus, the controllability is somewhat inferior as compared with the case in which the displacement of the compressor linearly changes in relation to the amount of displacement of the spool, as shown by a thinner line f, because the line $a_1$ is steeper than the line f. In the region of the spool displacement between 0 and e, however, the displacement of the compressor varies along a solid line $a_2$ which has a smaller gradient than the line f. This means that the compressor of this embodiment exhibits a superior displacement controllability particularly when the compressor operates with a small displacement capacity.

Thus, in the described embodiment of the variable-displacement compressor of the invention, the signal pressure passage 98 is brought into communication with the high-pressure introduction passage 96 so that the pressure in the control pressure chamber 200 is increased thereby to fully increase the displacement of the compressor to the maximum.

The fact that the displacement of the compressor is increased beyond the level demanded by the refrigeration system means that the cooling load is materially reduced relative to the power of the compressor. In consequence, the pressure comes down at the suction side. The reduction in the suction pressure causes a reduction in the pressure at which the refrigerant is introduced into the suction pressure chamber 416 through the lowpressure introduction passage 97, whereby the diaphragm 412 is deflected to the left as viewed in FIG. 3 by the force of the bias spring 417. The deflection of the diaphragm 412 is transmitted to the control valve member 403 through the connecting member 413, so that the control valve member 403 is moved away from the second valve seat surface 405a. In consequence, the signal pressure passage 98 is brought into communication with the low-pressure introduction passage 97, thereby allowing the internal pressure of the control pressure chamber 200 to be relieved into the low-pressure introduction passage 97. The reduction in the pressure in the control pressure chamber 200 causes the spool 30 to move correspondingly.

Thus, the displacement of the compressor is controlled in accordance with the amount of movement of the spool, so that, when the suction pressure is lowered, the displacement of the compressor is reduced to the level which matches with the cooling load applied to the refrigeration cycle. The described operation is repeated so that the displacement of the compressor is controlled so as to maintain a constant refrigerant pressure at the suction side of the compressor.

The compressor displacement control of the described embodiment of the compressor is conducted not only to maintain a constant suction pressure but also to positively change the suction pressure in accordance with the demand by the refrigeration cycle. The first-and second-mentioned types of control will be referred to as "constant suction pressure mode" and "variable suction pressure mode" hereinafter. The displacement control in the variable suction pressure mode is conducted by controlling the force of the biasing spring 417 by changing the excitation power of the coil 420, in contrast to the constant suction pressure mode in which the control is executed by maintaining the force of the biasing spring 417 constant.

For instance, when the cooling load imposed on the refrigeration cycle is increased due to an increase of the flow rate of air through the evaporator or a rise in the temperature of the air flowing through the evaporator, the change in the level of the load results in a change in the suction pressure, so that the pressure in the suction chamber 416 is changed. In addition, the output from the control circuit 500 is changed in accordance with a signal derived from the evaporator outlet air temperature sensor 502.

Figure 4B:
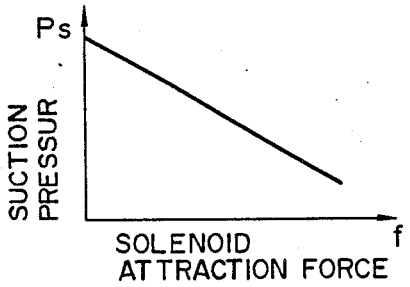
FIG. 4B is a graph showing the relationship between the suction pressure of the compressor and attracting force developed by a solenoid.
Figure 5:
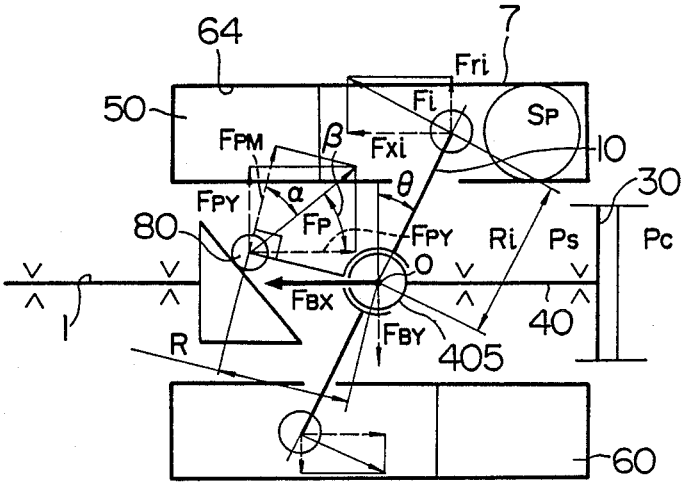
FIG. 5 is an illustration of the operation of the embodiment shown in FIG. 1.

The spool 415 is displaced to the right as viewed in FIG. 3 when the coil 420 is excited in accordance with the signal from the control circuit 500. As a result, the force of the biasing spring 417 is reduced, so that the pressure in the suction pressure chamber 416 for attaining the balance of force on the control valve member 403 is reduced. Since the displacement of the compressor is variably controlled on the basis of the suction pressure while the biasing force of the biasing spring 417 has been reduced, the balance of the force is attained at a lower level of the suction pressure. FIG. 4B is a graph showing the relationship between the suction pressure and the attracting force developed by the solenoid.

In general, the suction pressure of the compressor substantially coincides with the evaporation pressure in the evaporator, so that the reduction in the suction pressure allows the liquid refrigerant in the evaporator to evaporate at a lower temperature, whereby the temperature of the air at the evaporator outlet is lowered.

Thus, the compressor of this embodiment can effectively control the temperature of the air at the air outlet of the evaporator due to the self-control function for controlling the compressor displacement in accordance with a change in the suction pressure, as combined with the function for varying the force of the biasing spring by the magnetic force developed by the coil 420.

Figure 8:
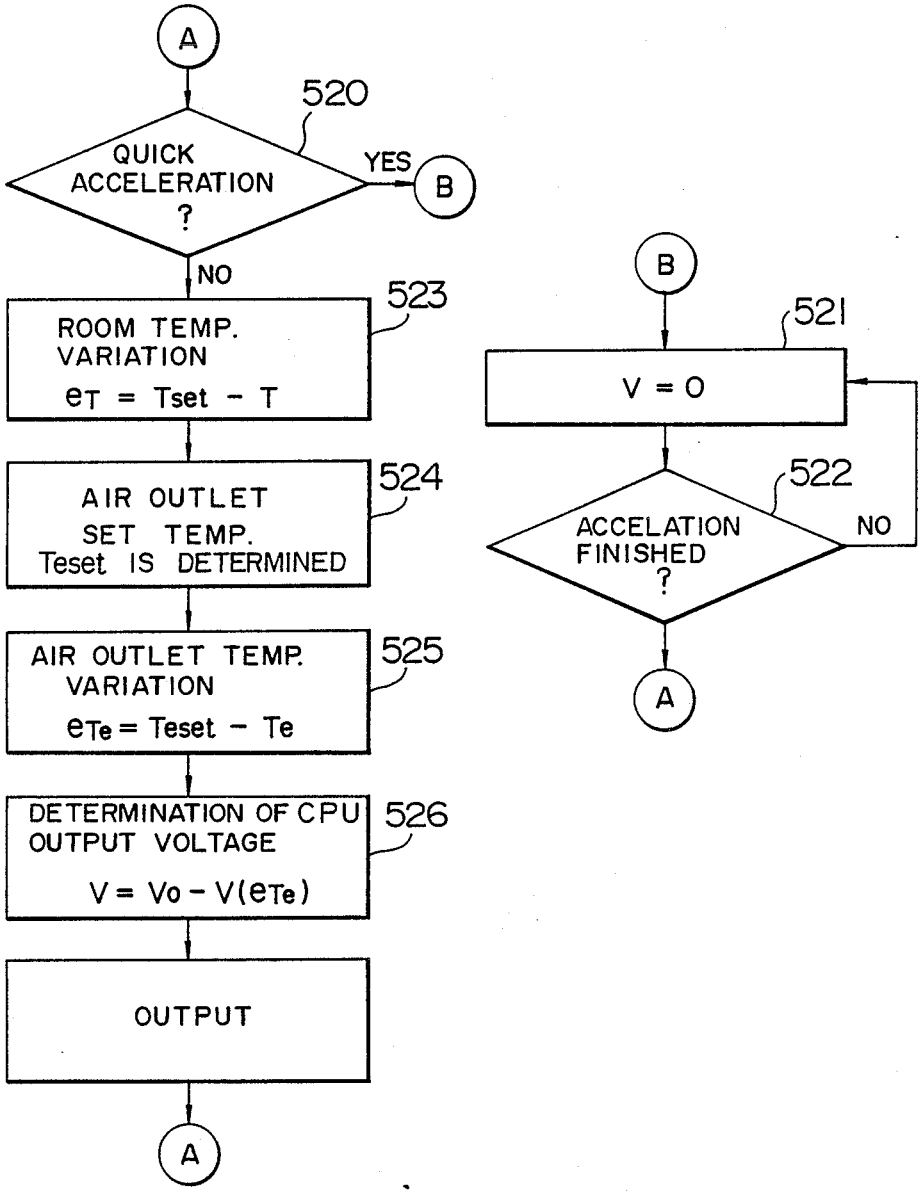
FIG. 8 is a flow chart showing the flow of control performed by the control circuit used in the embodiment shown in FIG. 1.

FIG. 8 is a flow chart showing an example of the control performed by the control circuit 500. Step 520 of this flow chart conducts a judgement as to the state of acceleration of the automotive engine from which the power for driving the compressor is derived. The judgment is conducted on the basis of a signal from the accelerator sensor 501. When the engine is being quickly accelerated, the displacement control for increasing the displacement of the compressor is not conducted. Namely, steps 521 and 522 are conducted so as to maintain the control output at "0" level until the acceleration of the engine is finished.

If the judgment in the step 520 has proved that the engine is not being accelerated, the process proceeds to a step 523 at which a variation $e^T$ of the room air temperature T from a set room temperature $T_{set}$ is detected. In a step 524, a control is executed to determine the set outlet air temperature $T_{set}$ and, in a subsequent step 525, a computation is executed to determine the outlet air temperature variation $eT_e$ which is obtained by subtracting the evaporator outlet air temperature Te from the set outlet air temperature $T_{eset}$. Thus, a series of computation is conducted by processing signals such as the signal from the evaporator outlet air temperature sensor 502 representative of the actual air temperature $T_e$ at the evaporator air outlet, the signal from the room air temperature sensor 503 representative of the actual room air temperature T and the signal representative of the set value $T_{eset}$ of the evaporator outlet air temperature. In a step 526, a control output voltage v from the CPU is determined.

Thus, in the described embodiment, the control circuit 500 operates in accordance with signals from the sensors 502 and 503 so as to deliver an output voltage which is used in the control of the compressor displacement for attaining a desired air temperature at the air outlet of the evaporator.

The preferred embodiment described hereinbefore is only illustrative and, hence, can be changed or modified in various manners.

Figure 9:
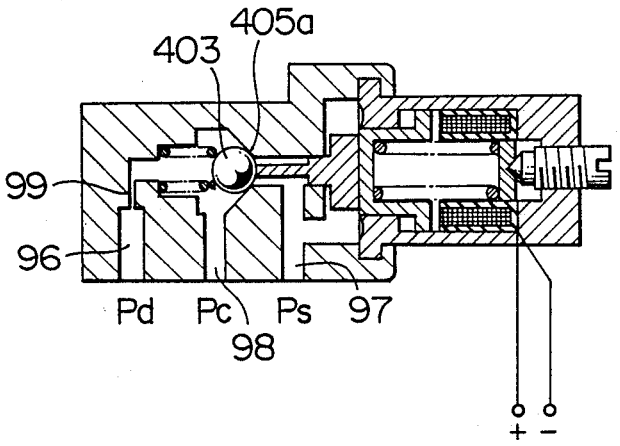
FIGS. 9 to 11 are sectional views of different examples of the control valve used in the compressor of the present invention.
Figure 10:
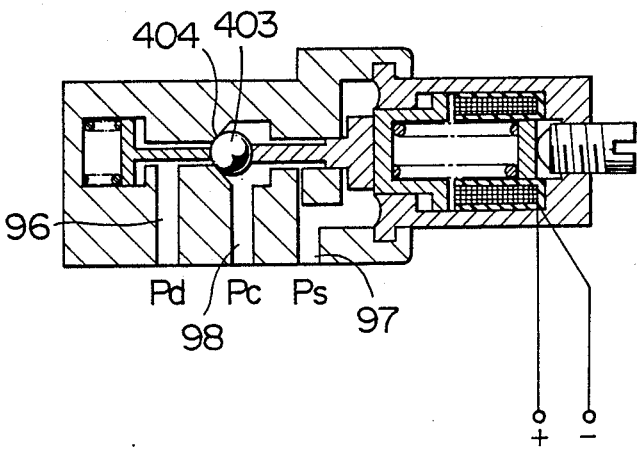

For instance, the control valve may alternatively be arranged such that, as shown in FIG. 9, the signal pressure passage 98 and the high-pressure introduction passage 96 are always maintained in communication with each other through an orifice 99, though in the described embodiment the control valve is constructed to control the states of communications between the low-pressure introduction passage 97 and the signal pressure passage 98 and between the high-pressure introduction passage and the signal pressure passage 98 by means of the control valve member 403. The alternative arrangement shown in FIG. 9 enables, by the movement of the control valve member 403 into and out of sealing engagement with the valve seat surface 405a, the control pressure derived from the signal pressure passage 98 to be varied between the level of the high pressure introduced from the high-pressure introduction passage 96 and the low pressure introduced through the low-pressure introduction passage 97. Conversely, the arrangement may further alternatively be such that the signal pressure passage 98 is always maintained in communication with the lowpressure introduction passage 97 as shown in FIG. 10. In this case, the control valve 403 is moved into and out of sealing engagement with the valve seat surface 404 so as to open and close the high-pressure introduction passage 96. The control pressure is changed between the level of the high pressure introduced through the highpressure introduction passage 96 and the level of the low pressure introduced through the low-pressure introduction passage 97.

Figure 11:
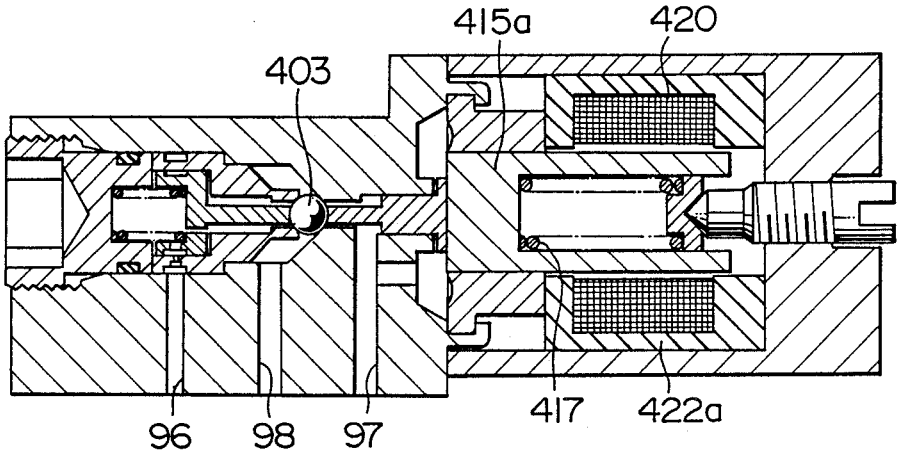

In the arrangement shown in FIG. 3, the spool 415 is adapted to contact at its end surface with the yoke 422 and the cylindrical member 421. This arrangement, however, may be modified such that, as shown in FIG. 11, a spool 415*a* is receivable in the coil 420. In this arrangement, the magnetic force developed between the spool 415*a* and the yoke 422*a* is not substantially changed when the spool 415*a* is displaced. Thus, the embodiment shown in FIG. 11 ensures that the spool 415*a* is displaced without fail in accordance with a change in the electric current supplied to the coil 420.

Figure 12:
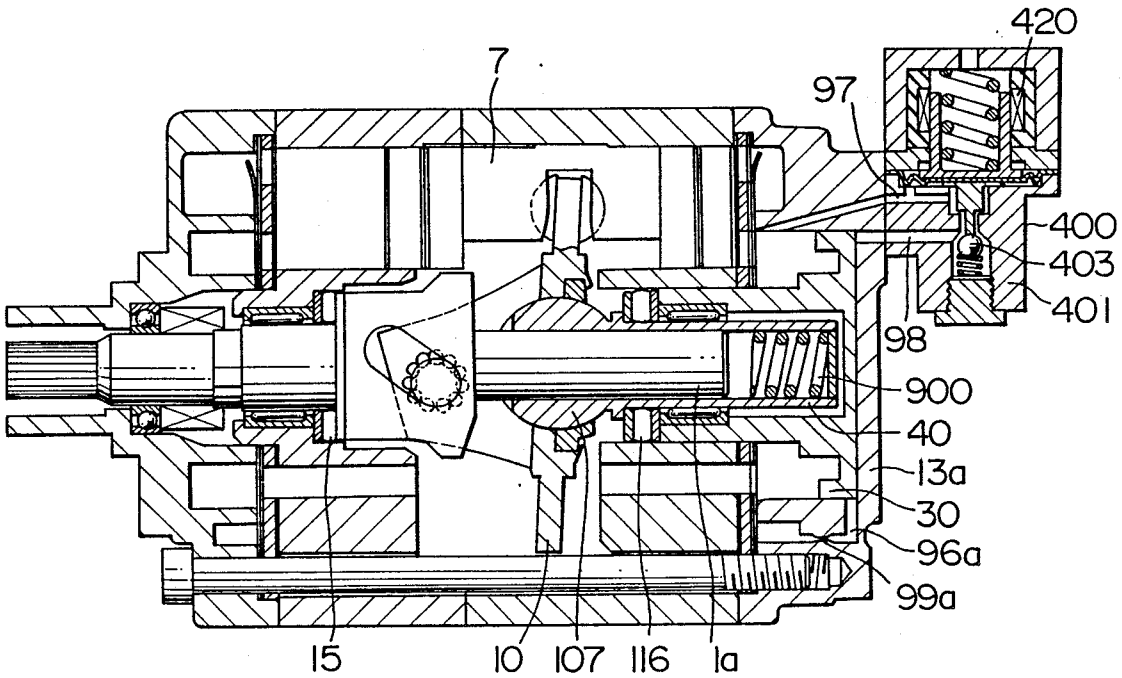
FIG. 12 is a sectional view of another embodiment of the compressor in accordance with the present invention.

FIG. 12 shows another embodiment of the compressor of the present invention. This compressor employs a control valve 400 having a construction similar to that of the control valve shown in FIG. 11. The compressor shown in FIG. 12 is constructed such that the compressor displacement is controlled by a combination of the control of tilting angle of the swash plate 10 and the change in the position of the center of the swash plate 10, as in the case of the compressor shown in FIG. 1. In the compressor of FIG. 12, however, a shaft la extends through the swash plate 10 and is supported at its both ends. In addition, the housing 401 of the control valve 400 has only the signal pressure passage 98 and the low-pressure introduction passage 97 formed therein. A high-pressure introduction passage 96*a* and an orifice 99*a* are formed in a rear housing 13*a*, unlike the compressor of FIG. 1 in which the highpressure introduction passage and the orifice are formed in the rear housing 13. The embodiment shown in FIG. 12 further includes a return spring 900 which operates when the stroke of the spool 30 has exceeded a certain value, e.g., 7 mm. The effect produced by the return spring 900 will be described later. The control valve 400 used in the compressor of FIG. 12 operates substantially in the same manner as the control valve described before in connection with FIG. 9. Though the control valve 400 essentially requires the high-pressure introduction passage, it is not always necessary that this passage is formed in the housing of the control valve.

Figure 13:
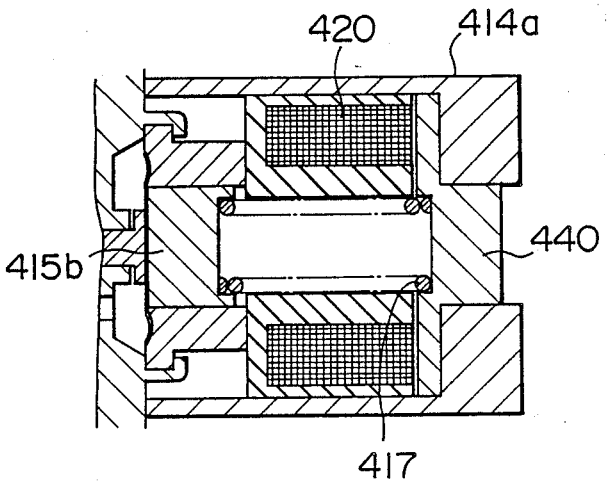
FIG. 13 is a sectional view of a different example of the control valve used in the compressor of the present invention.

FIG. 13 shows a further modified arrangement in which the magnetic force produced by the coil 420 when the same is energized acts in the same direction as the force produced by the biasing spring 417, in contrast to the described embodiments in which the force produced by the coil 420 acts to reduce the effect of the biasing spring 417. In the arrangement shown in FIG. 13, the hbiasing spring 417 engages at its one end with a spool 415*b*, while the other end of the biasing spring 417 is retained by a spring retainer 440.

The spring retainer 440 is slidably held in a solenoid housing 414*a* so as to be moved by the electromagnetic force produced by the coil 420. Therefore, the spring retainer 440 is moved to the left as viewed in FIG. 13 when the coil 420 is energized, with the result that the set pressure of the biasing spring 417 is increased.

Figure 14:
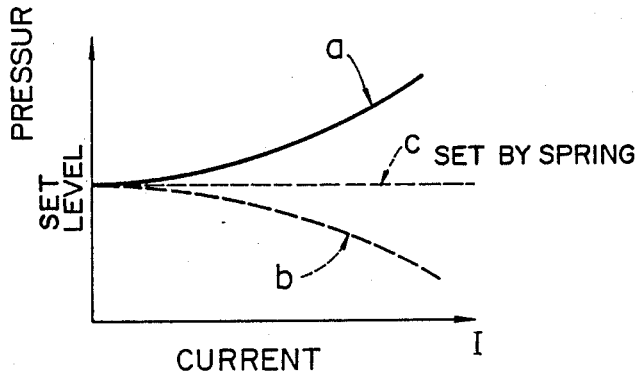
FIG. 14 is an illustration of the relationship between the electric current value in each of the control valves shown in FIGS. 3 and 13 and the set value of a spring force.

FIG. 14 shows the operation characteristic of the embodiment of FIG. 13 in comparison with those of the preceding embodiments. More specifically, a solid-line curve in FIG. 14 shows the characteristic of the embodiment shown in FIG. 13, while a broken-line curve b shows the characteristic in other embodiments. A chain line c shows the set value of the biasing spring 417 as obtained when the coil 420 is omitted.

Figure 15:
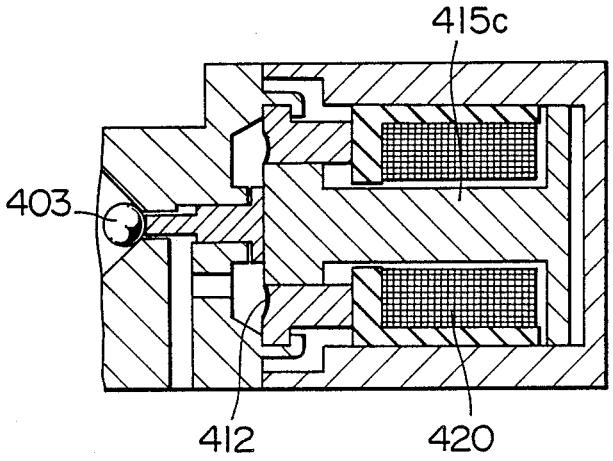
FIG. 15 is a sectional view of a different example of the control valve used in the compressor of the present invention.

In the embodiments described hereinbefore, the electromagnetic force produced by the coil 420 is used to assist or to negate the effect of the biasing spring 417. The arrangement, however, may be modified such that a spool 415*c* is directly actuated by the electromagnetic force of the coil 420, as shown in FIG. 15. In this embodiment, the spool 415*c* is received in the central bore of the coil 420 and the spool 415 is moved to the left and right as viewed in the drawings in accordance with the level of the electric current supplied to the coil 420.

The inventors have conducted a series of experiments and found that, in some cases, the described embodiments of the variable displacement swash-plate type compressor fail to correctly control the position of the spool 30.

Figure 17:
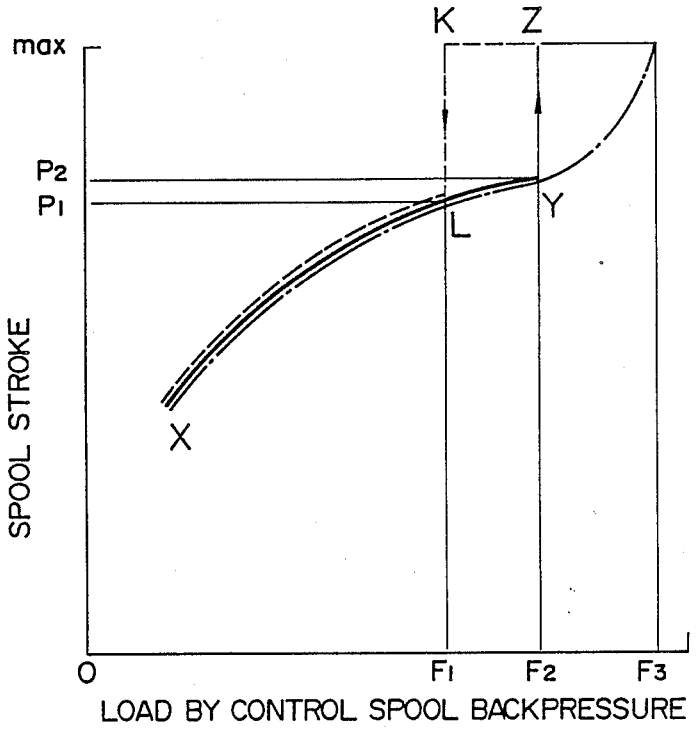
FIG. 17 is an illustration of the relationship between a spool back pressure and a spool stroke as observed in a compressor which does not employ an auxiliary loading means.

When the back pressure acting on the spool 30 is increased, the spool is displaced linearly in accordance with the increase in the back pressure until the back pressure reaches a predetermined levle $F_2$, as shown by a solid-line curve X-Y in FIG. 17 in which the axis of ordinate represents the displacement of the spool 30 corresponding to the amount of change in the tilting angle of the swash plate 10 and, hence, to the length of the stroke of the reciprocatory motion of the pistons 7.

The inventors have found that, when the back pressure acting on the spool 30 is increased beyond the predetermined level $F_2$, the spool 30 is immediately displaced to the stroke end, rather than moving linearly, as shown by a solid-line curve YZ. Namely, the spool 30 is held at the stroke end, i.e., in the fully displaced position whenever the back pressure acting on the spool 30 exceeds the predetermined level $F_2$.

Conversely, in the course of reduction in the back pressure acting on the spool 30, the spool 30 is held in the fully displaced position even when the back pressure load is reduced from the maximum value $F_3$ to a predetermined level $F_2$ and further to a smaller value $F_1$, as shown by a broken-line curve ZK. Then, as the back pressure on the spool 30 comes down below the predetermined value $F_1$, the spool 30 is moved by a predetermined amount at once, as shown by a broken line KL.

Figure 18:
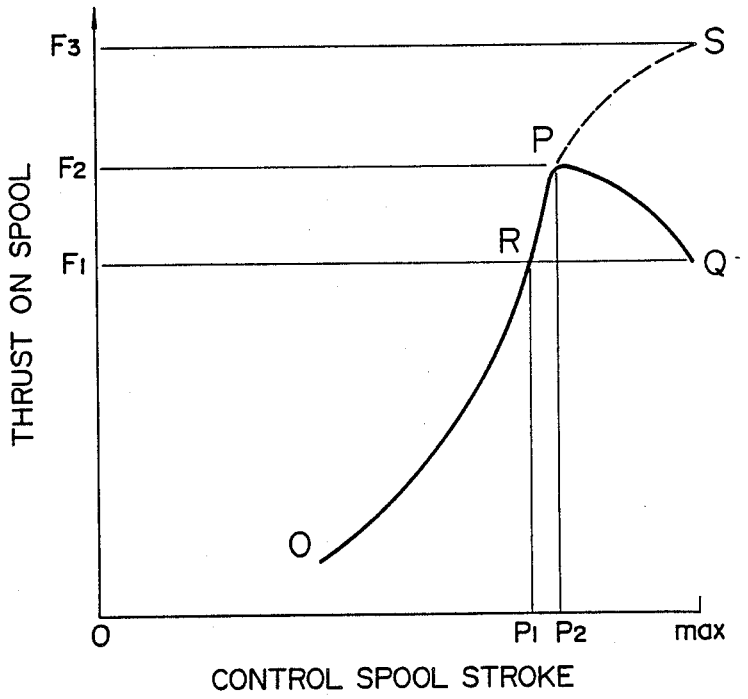
FIG. 18 is an illustration of the relationship between a spool stroke and a thrust force acting on the spool as observed in a compressor which does not employ an auxiliary loading means.

The inventors have found that the abovedescribed non-linear behaviour of the spool 30 is attributable to the fact that a specific relationship shown in FIG. 18 tends to exist between the stroke positions of the spool 30 and the axial force exerted on the spool 30 by the shaft 1. Referring to FIG. 18, a point O represents a state in which the stroke of the spool 30, the tilting angle of the swash plate 10 and the stroke of the pistons 7 are minimized. As the stroke of the spool 30 is increased from this state, the stroke of the pistons 7 is increased correspondingly so that the thrust force available for the displacement of the spool 30 is increased, as shown by a solid-line curve OP. The experiment showed, however, that a further increase in the stroke of the spool 30 reduces the force required for displacing the spool 30, as shown by a solid-line curve PQ. The state shown by the solid-line curve PQ corresponds to a region in which the stroke of the pistons 7 is controlled to its maximum value and in which the displacement of the compressor is slightly reduced from the maximum value.

More specifically, as shown in FIG. 18, there is a point P corresponding to the maximum value $F_2$ of the thrust force required for displacing the spool 30 and the spool stroke corresponding to this maximum force $F_2$ is represented by $P_2$. This value $P_2$ of the stroke of the spool corresponds to the point Y in FIG. 17. As described before, when the thrust force is increased beyond the predetermined force $F_2$, the spool 30 is immediately advanced to the full stroke position corresponding to points Z and Q in FIGS. 17 and 18. This state is maintained until the back pressure acting on the spool 30 is reduced to a level below the thrust force $F_1$ which is necessary for holding the spool 30 at the full stroke position. When the back pressure acting on the spool 30 is reduced down below the thrust force $F_1$, the spool 30 is caused to immediately move from the point Q to a point R in FIG. 18. The stroke of the spool 30 corresponding to this point R is represented by $P_1$ in FIG. 18 and to the point L in FIG. 17.

Figure 19:
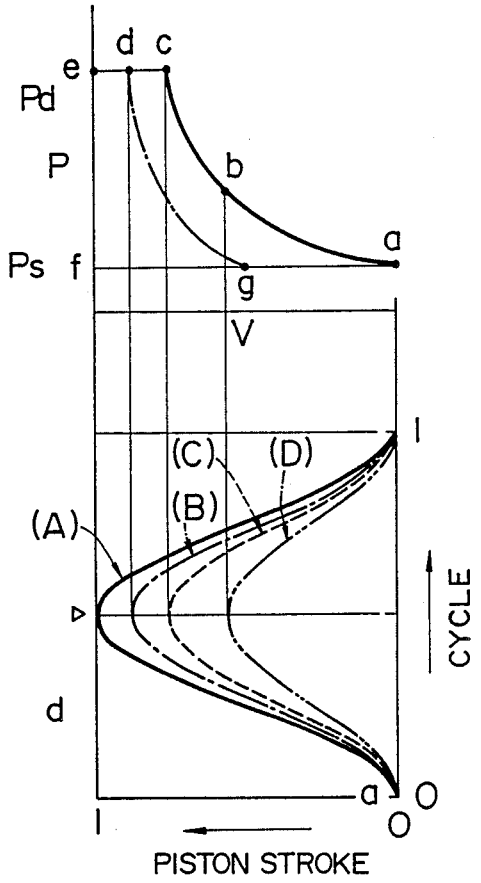
FIG. 19 is an illustration of the state of a change in the stroke of a piston in a first working chamber.

The characteristic as shown in FIG. 18 is attributable to the fact that, in the swash-plate type compressor of the invention, dead volumes are produced only in the first working chambers 50 when the displacement of the spool 30 is small, as will be understood from the following description with reference to FIG. 19.

FIG. 19 shows the relationship between the stroke of the pistons 7 and the pressure in the first working chambers 50, i.e., the relationship between the internal volume and the pressure in each of the working chambers 50. In the state shown by a solid-line A in FIG. 19, the pistons 7 is allowed to fully stroke, i.e., the stroke of the pistons 7 is maximized, so that the compressor operates with the maximum displacement. A one-dot-and-dash line B in FIG. 19 shows the state in which the tilting angle of the swash plate 10 has been slightly decreased with the stroke length of the pistons 7 reduced correspondingly. The state shown by the one-dot-and-dash line B, therefore, allows a certain dead volume to be generated between the pistons 7 and the side plate 8. A broken-line curve C in FIG. 19 shows a state in which the tilting angle of the swash plate 10 is further decreased to cause a corresponding increase in the dead volume. Finally, two-dot-and-dash line D in FIG. 19 shows the state in which the tilting angle of the swash plate 10 and, hence, the stroke length of the pistons 7 are minimized to maximize the dead volume.

Description will be made first of the state shown by the solid-line curve A in which the pistons 7 are allowed to fully stroke to the maximum stroke length of the pistons 7. As a pistons 7 is advanced from the fully retracted position denoted by a, the volume in a working chamber 50 is progressively decreased while the pressure in the working chamber 50 is increased, as shown by a curve a-b-c in the Figure. When the internal pressure of the working chamber 50 has reached a predetermined pressure Pd, the discharge valve 24 is opened so that the internal pressure of the working chamber 50 no more increases, as shown by a curve c-d-e. The pistons 7 is then moved to the maximum stroke position which is represented by e and then starts to move backward. During the backward movement of the pistons 7, the suction port 25 is opened so that the pressure in the working chamber 50 drops immediately to the level of the suction pressure Ps as indicated by f and then the pistons 7 returns to the fully retracted position shown by a. Thus, when the piston stroke length is maximized, the pressure in the working chamber 50 cyclically changes along the loop defined by the points a, c, e, f and a.

When the tilting angle of the swash plate 10 is slightly decreased so as to allow generation of a dead volume on the end of the piston 7, a predetermined amount of refrigerant is left in the working chamber 50. Therefore, when the piston 7 is moved backward from the fully extended position, the refrigerant held in the working chamber 50 expands as shown by one-dot-and-dash line d-g so that the internal pressure of the working chamber is held above the suction pressure Ps.

As the tilting angle of the swash plate 10 is further decreased, the length of the stroke of the piston is correspondingly decreased so as to allow a large dead volume to be created in the working chamber 50 until a state is reached the discharge valve 24 can no more be opened even when the piston 7 is fully extended. Namely, the pressure generated in the working chamber 50 does not exceed the discharge pressure Pd even when the piston 7 is fully moved to the top dead center. This state is shown by the broken-line curve C in FIG. 19. Thus, the pressure and volume vary along a loop a-b-c-b-a in FIG. 10. As the tilting angle of the swash plate 10 is further decreased to cause a further reduction in the stroke of the piston 7, a state shown in the two-dot- and-dash line D in FIG. 19 is obtained in which suction and discharge are no more performed in the working chamber. Thus, the volume and the pressure in the working chamber 50 vary in relation to each other along a curve a-b-a.

As will be understood from the foregoing description, the level of the pressure which can be established in each working chamber 50 during reciprocatory motions of the piston 7 varies due to the generation of a dead volume in the working chamber 50.

Figure 20:
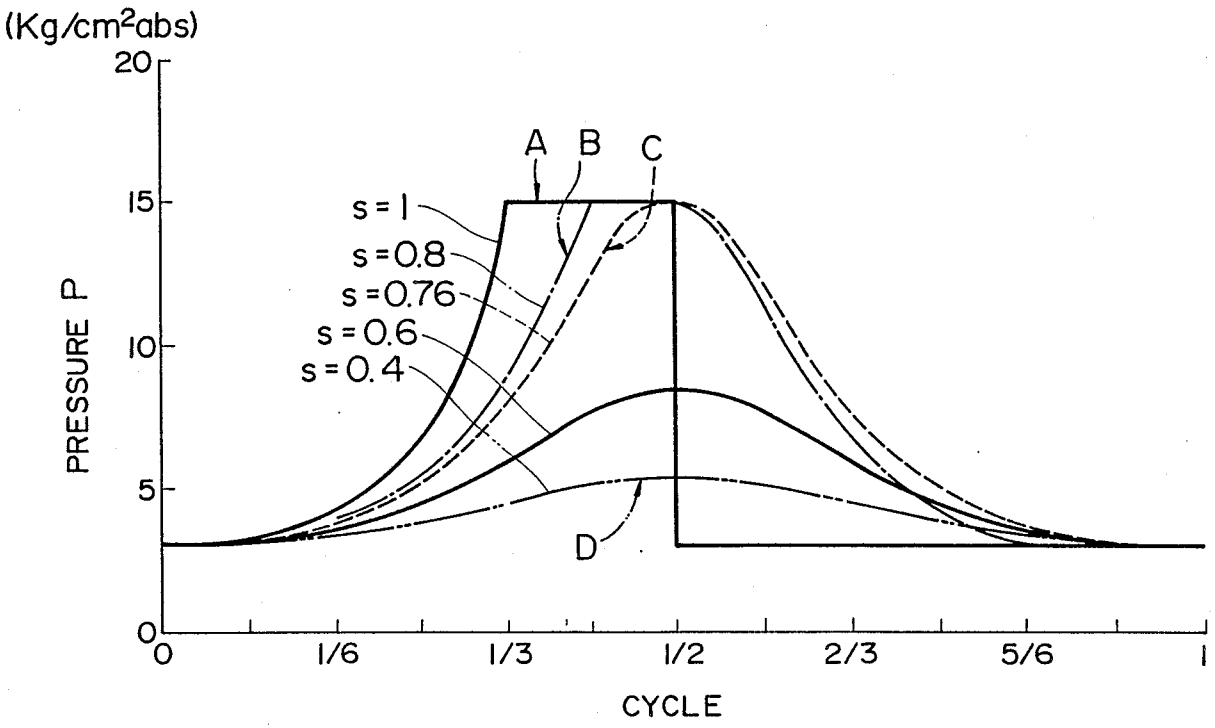
FIG. 20 is an illustration of the state of a change in the pressure within the first working chamber.

FIG. 20 is a graph illustrating the relationship between the pressure in each working chamber 50 and the cycle of reciprocation of an associated piston 7. In FIG. 20, a solid-line curve A shows the state corresponding to the solid-line curve A in FIG. 19. In this state, no dead volume is formed on the end of the piston 7 so that the pressure in the working chamber 50 is reduced to the level of the suction pressure Ps immediately after the commencement of the backward stroking of the piston 7. A one-dot-and-dash line B in FIG. 20 represents the state corresponding to the state shown by one-dot-and-dash line curve B in FIG. 19. In this state, a certain dead volume is generated in the working chamber 50, so that a residual pressure due to the presence of the dead volume exists in the working chamber 50. Namely, the pressure in the working chamber 50 does not come down to the level of the suction pressure immediately after the commencement of the backward stroking of the piston 7, but the pressure is progressively lowered from the level of the discharge pressure to the level of the suction pressure Ps. A broken-line curve C in FIG. 20 shows a state corresponding to the state shown by the broken-line curve C in FIG. 19. In this state, the dead space has grown to a large value so that the internal pressure of the working chamber 50 merely changes along a curve similar to a sine wave without coming down to a level below the suction pressure Ps.

A two-dot-and-dash line curve D in FIG. 20 shows a state corresponding to the state shown by the two-dot-anddash line curve D in FIG. 19. In this case, the pressure varies substantially along a sine wave form as in the case of the state of the broken-line curve C. Moreover, in the state shown by the two-dot-and-dash line curve D in FIG. 20, the amplitude of the internal pressure variation is decreased; namely, the maximum pressure reached in the working chamber 50 is decreased.

Referring back to FIG. 18, the region between the points P and Q corresponds to the transient state in which the relationship between the pressure and volume in the cycle is changed from the state shown by the solid-line curve A to the broken-line curve C in FIG. 19. In this region, as will be understood from FIG. 20, an urging force is applied to the piston in the first working chamber 50 to urge the piston 7 to the right as viewed in FIG. 1, due to the presence of the residual pressure in the working chamber 50. This rightward urging force applied to the piston 7 in the first working chamber 50 acts to increase the tilting angle of the swash plate 50. Namely, the residual pressure in the working chamber 50 causes the angle of tilt of the swash plate 10 to be increased, so as to increase the stroke length of the reciprocatory motion of the piston 7. The behaviour of the compressor in this transient period is observed in the region shown by the solid-line curve PQ in FIG. 18. In this region, the residual pressure in the working chamber 50 increases as the residual pressure in the working chamber 50 increases. In this region, therefore, the thrust force required for urging the spool 30 to the left as viewed in FIG. 1 is increased in accordance with the increase in the dead volume.

As will be understood from the foregoing description, the thrust load required for axially moving the spool 30 is affected by the internal pressure of the first working chamber 50 when the stroke position is changed from the position corresponding to $P_2$ in FIG. 18 to the maximum stroke position. More specifically, the thrust load for axially displacing the spool 30 is progressively decreased as the spool 30 moves to the left as viewed in FIG. 1. In consequence, a non-linear relationship as shown in FIG. 18 exists between the stroke of the spool 30 and the thrust force which is required for displacing or moving the spool 30. It will be seen that such a non-linear relationship makes it impossible to exactly control the displacement of the compressor solely by the control of the internal pressure of the control pressure chamber 200. In order to linearly control the displacement of the compressor, it is necessary that a characteristic as shown by a broken-line curve PS in FIG. 18 is obtained. The return spring 900, which was referred to hereinabove in connection with FIG. 12, is used to realize such a characteristic. The return spring 900 serves as an auxiliary loading means which serves to urge the spool 30 in such a direction as to reduce the displacement of the compressor, thereby compensating for the non-linearity of the characteristic curve shown in FIG. 18.

The return spring 900 is designed to be effective in the region between the point $P_2$ (see FIG. 18) of the spool stroke where the thrust force is maximized and the maximum spool stroke. The return spring 900 should have a spring constant large enough to compensate for the reduction of the thrust load at the right side of the stroke point $P_2$ in FIG. 18.

An assumption is made here that, in a compressor of the type shown in FIG. 12, the stroke of the spool 30 which maximizes the tilting angle of the swash plate 10 is 0 mm, while the maximum spool stroke which minimizes the tilting angle of the swash plate is 10 mm. Therefore, when the spool 30 is set at the maximum stroke position, each piston 7 is allowed to perform reciprocation over a stroke length of 20 mm. It is also assumed that the compressor has the maximum displacement of 180 cc. Assumption is also made that the suction pressure is 3 $kg/cm^2$·abs, while the discharge pressure varies between 12 $kg.cm^2$·abs and 18 $kg/cm^2$·abs. In such a case, the inversion of the characteristic curve in FIG. 18 takes place when the stroke of the spool 30 has become 7 mm or greater. In the embodiment shown in FIG. 12, therefore, the return spring 900 is set such that it produces compression load when the stroke of the spool 7 has been incresed beyond 7 mm. The spring constant of this spring 900 is determined to be, for example, 33 kg/mm.

In the operation of the compressor having this return spring 900, the characteristic varies along the curve OP in FIG. 18 when the spool 30 is at a stroke position between 0 and 7 mm so that the stroke of the spool 30 increases in accordance with an increase in the back pressure acting on the spool 30. In the region where the spool stroke has exceeded 7 mm, the rightward displacement of the spool 30 cannot be caused unless a load overcoming the set load of the return spring 900 is applied to the back side of the spool. Thus, the reducing tendency of the spool-driving thrust can be negated and a linear relationship is obtained between the spool stroke and the thrust force, by virtue of the addition of the return spring 900.

Figure 21:
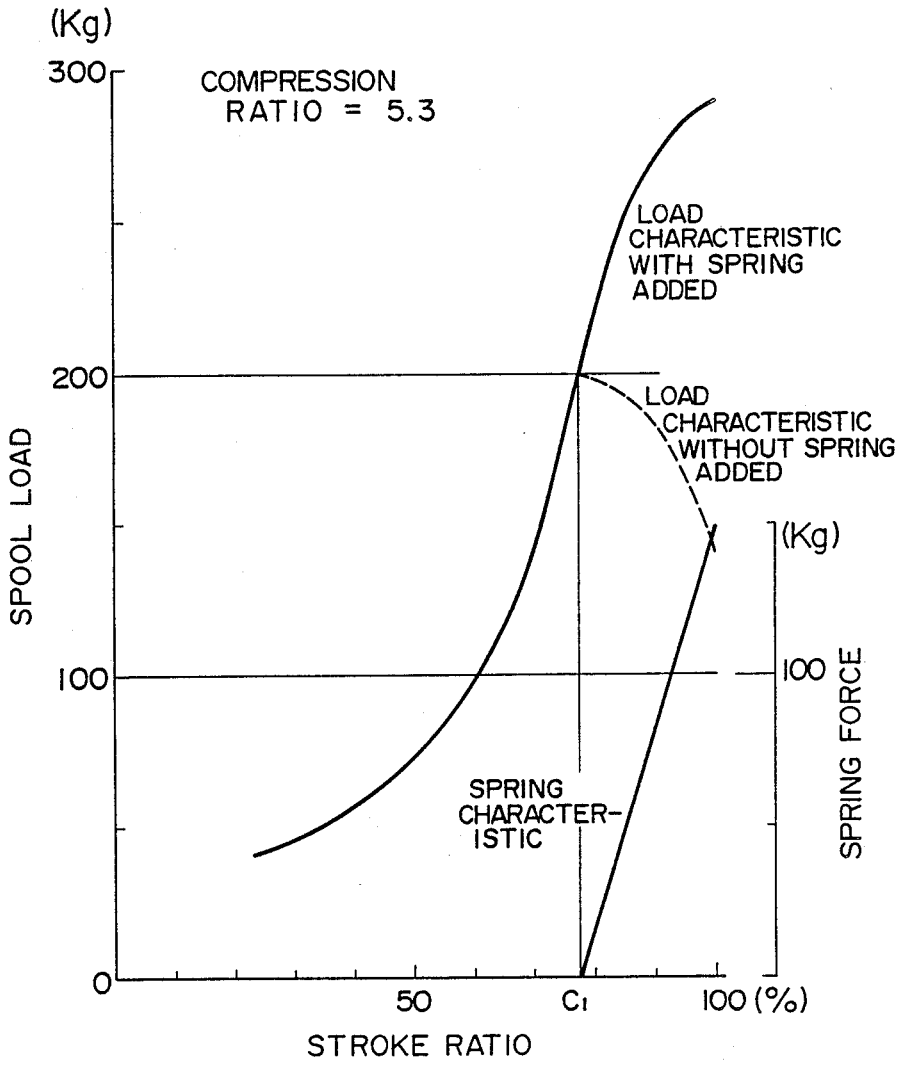
FIG. 21 is an illustration of the relationship between the spool stroke ratio and the load applied to the spool as observed in a compressor incorporating an auxiliary load means having a linear spring characteristic.

In consequence, the non-linearity between the stroke of the spool 30 and the driving thrust, attributable to the presence of the dead volume in the working chamber 50, in overcome by the provision of the return spring 900, as will be seen from FIG. 21.

The foregoing description of operation taken in conjunction with FIGS. 18 to 21 is based on an assumption that the suction pressure Ps and the discharge pressure Pd are constant. However, the compressor when actually used as a refrigeration compressor experiences changes in the suction pressure Ps and the discharge pressure Pd, or compression ratio, in accordance with various factors such as the operating condition under which the refrigeration cycle is required to operate, environmental air temperature around the compressor, and so forth.

Figure 22:
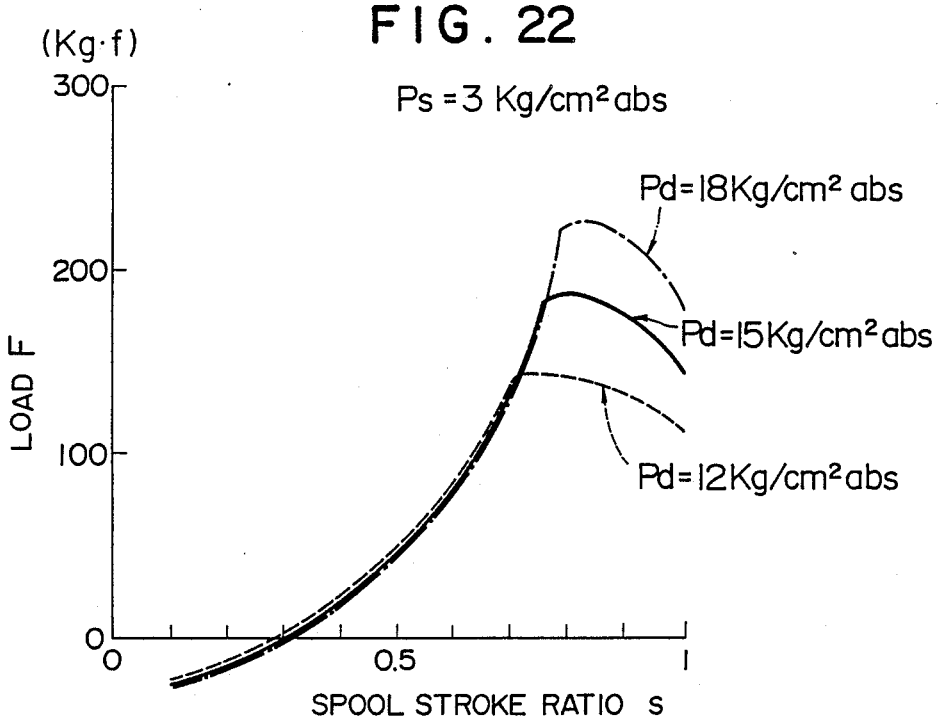
FIG. 22 is an illustration of the manner in which the load is changed in accordance with a change in the discharge pressure.

For instance, suction pressure Ps and the discharge pressure Pd are generally about 2.5 $kg/cm^2$·abs and 16 $kg/cm^2$·abs, respectively, during light-load operation of the refrigeration cycle. When a large thermal load is imposed on the refrigeration cycle, the suction pressure Ps and the discharge pressure Pd often rise to the levels of 4 $kg/cm^2$·abs and 26 $kg/cm^2$·abs, respectively. Thus, the suction and discharge pressures are changed in accordance with a change in the thermal load, with the result that the compression ratio $\epsilon$ also is changed. FIG. 22 shows the thrust load required for axially displacing the spool 30 under a condition where the discharge pressure Pd is changed in various manners. As will be seen from this Figure, the thrust load required for displacing the spool increases as the discharge pressure becomes higher. In particular, a large change in the thrust load is experienced in the beginning period in which the formation of the dead volume has just begun, as shown in FIG. 22. This is because the pressure generated due to the presence of the dead volume acts to urge the spool 30 backward through the pistons 7 and the swash plate 10. Namely, when the discharge pressure is high, the pressure generated in the working chambers 50 due to the presence of the dead volumes therein is correspondingly high, so that the thrust load required for axially displacing the spool 30 is also increased correspondingly.

Figure 23:
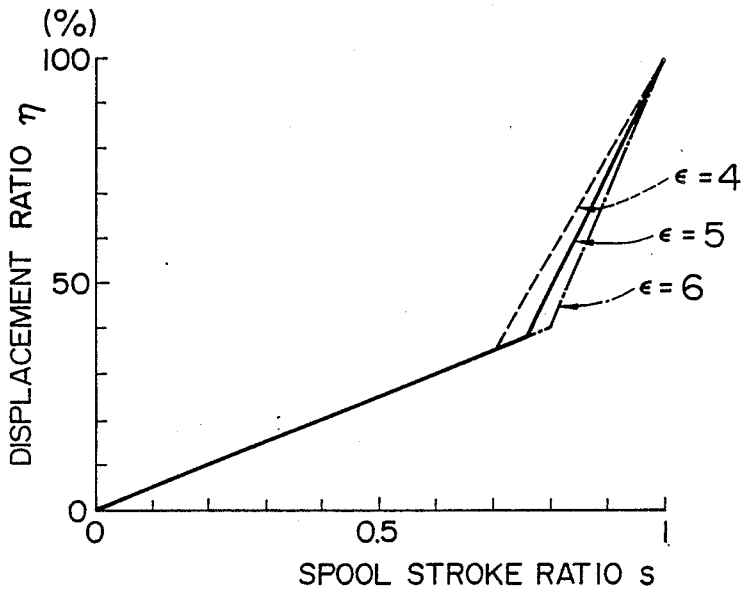
FIG. 23 is an illustration of the relationship between the displacement ratio and the spool stroke ratio.

As will be seen from FIG. 22, no influence of the discharge pressure remains in the working chambers 50 when the dead space has become greater than a predetermined value. Consequently, when the spool 30 has been displaced beyond a predetermined stroke position, the thrust force required for a further displacement of the spool is not changed regardless of the change in the discharge pressure. As a result, the relationship as shown in FIG. 7 between the amount of movement of the spool 30 and the displacement of the compressor varies in accordance with changes in the suction pressure Ps and the discharge pressure Pd, as shown in FIG. 22. In FIG. 23, a solid-line curve shows a rated operation of the compressor at a compression ratio $\epsilon$ of 5. A broken-line and a one-dot-and-dash line show, respectively, a light-load operation and a heavy-load operation at compression ratios $\epsilon$ of 4 and 6, respectively.

Figure 24:
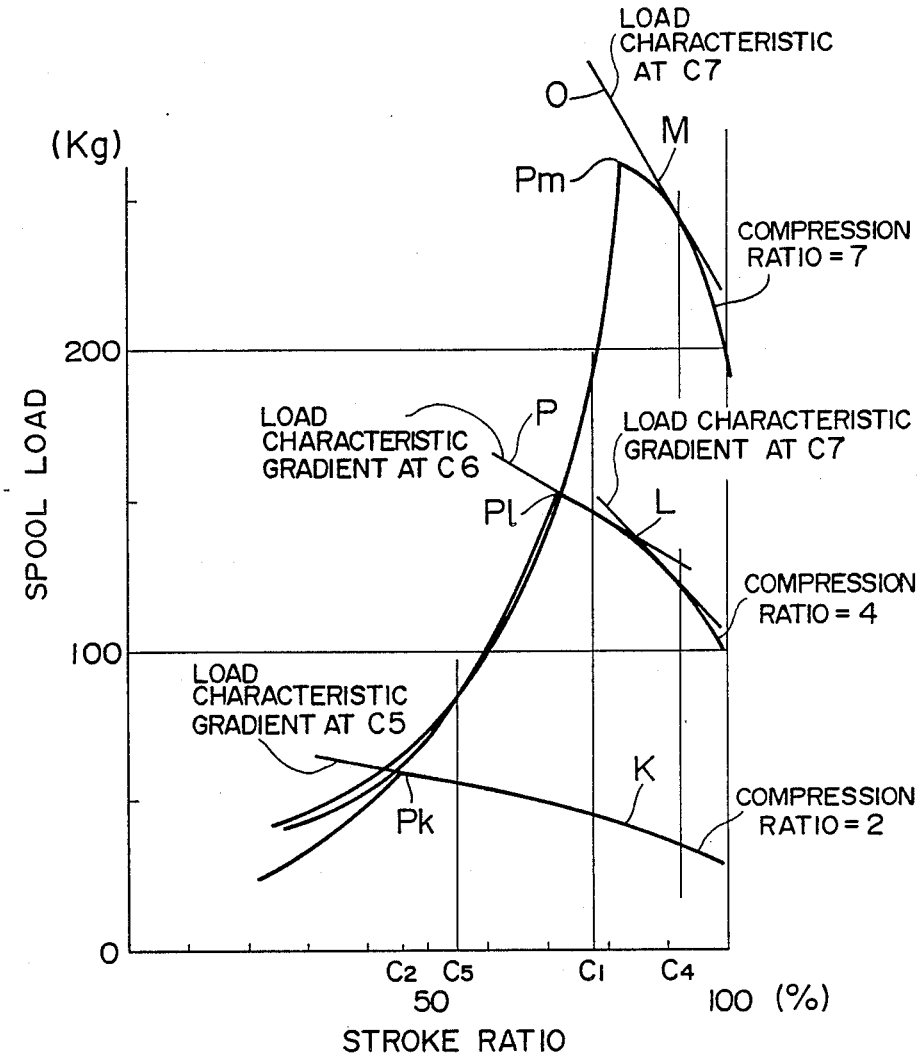
FIG. 24 is an illustration of the relationship between a change in the compression ratio and a change in the load applied to the spool.

FIG. 24 shows, as is the case of FIG. 22, a relationship between the spool stroke ratio and the spool load. More specifically, FIG. 24 shows the manner in which the spool load is varied in relation to a change in the compression ratio. In FIG. 24, a solid-line curve K shows the state in which the compression ratio is 2, while a solid-line curve L represents the state in which the compression ratio is 4. A solid-line curve M shows the state in which the compression ratio is 7.

Figure 25:
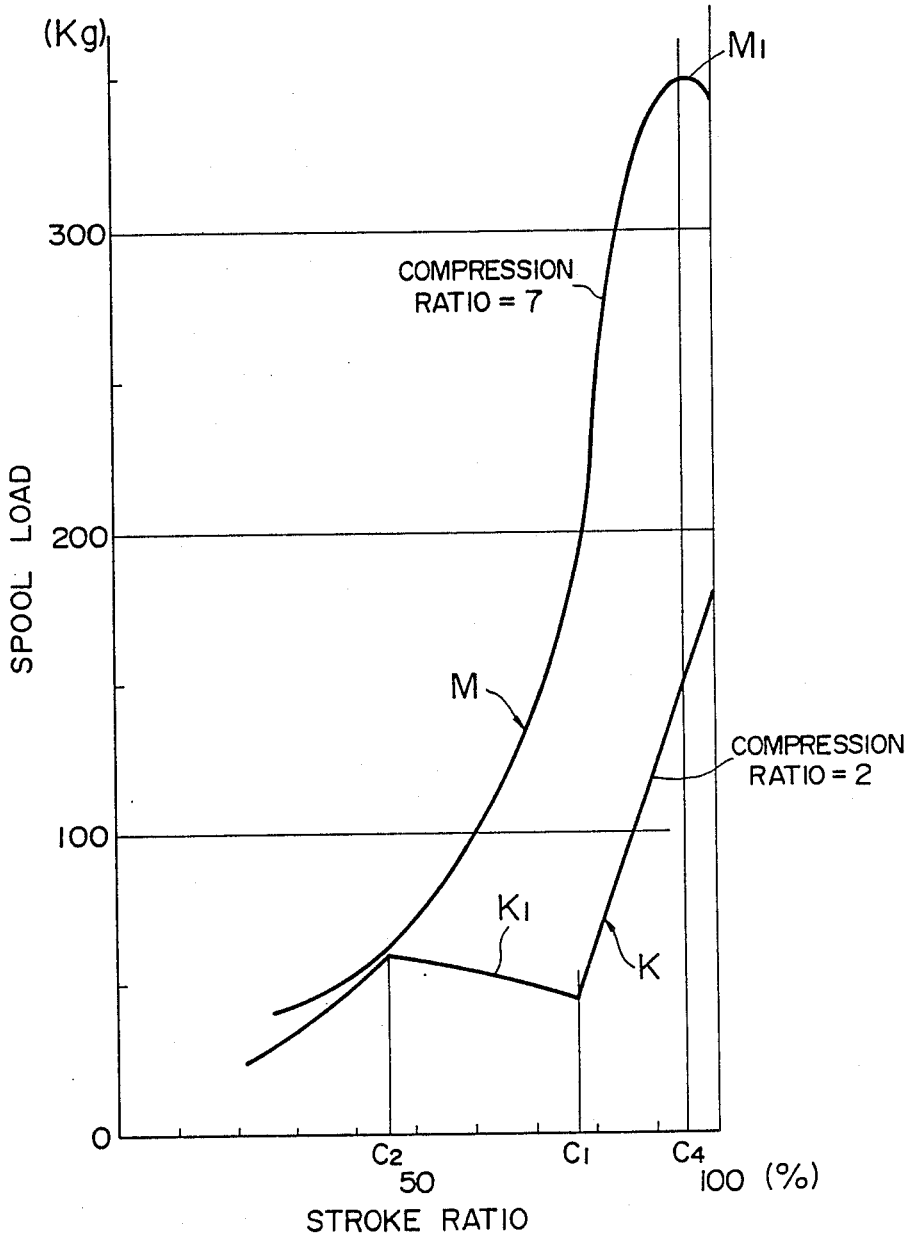
FIG. 25 is an illustration of the relationship between the spool stroke ratio and the spool load as obtained when a spring having a linear characteristic is used as an auxiliary loading means.

Thus, the state of change in the thrust load on the spool varies in accordance with a change in the compression ratio. Therefore, when a spring having the characteristic shown in FIG. 21 is used as the return spring 900, the linearity of the spool load in relation to the spool stroke may be failed depending on the compression ratio. More specifically, in the characteristic shown in FIG. 21, the return spring 900 produces an urging force when the stroke ratio is $C_1$. When the compression ratio is 2 (curve K in FIG. 24) or 4 (curve L in FIG. 24), the peak points Pk and P( of the spool load appear at regions where the stroke ratio is comparatively small. In these cases, therefore, a reduction in the thrust load required for driving the spool is inevitably caused as shown in FIG. 25.

This phenomenon is shown by the portion $K_1$ of a solid-line curve K showing the compression ratio. The portion $K_1$ corresponds to the region between the stroke ratio $C_2$, corresponding to the peak point Pk obtained at the compression ratio of 2, and the stroke ratio $C_1$ at which the return spring 900 becomes to operate.

The negative gradient of the spool thrust load also takes place when the peak Pm of the spool thrust load appears at a point $C_4$ (see FIG. 24) which is in the region where the stroke ratio is greater than the stroke ratio $C_1$ where the return spring 900 becomes effective, as in the case where the compression ratio is, for example, 7 as shown by a solid-line curve M in FIG. 24. This state is shown by a portion $M_1$ of the curve M in FIG. 25. Namely, when the compression ratio is 7, the peak point Pm appears when the stroke ratio is greater than $C_1$. If the negative gradient of the spool load as shown by a curve O in FIG. 24 is greater than the positive gradient of the characteristic of the return spring shown in FIG. 21, the difference appears as the negative gradient of the curve shown in FIG. 25.

The inventors have confirmed that, for the reasons described above, a simple correlation between the stroke ratio and the spool load cannot be obtained solely by the provision of the return spring 900.

The inventors have also found that one of the critical factors for obtaining a simple correlation between the stroke ratio and the spool load is the gradient of the curve representing the spool load in the region where the stroke ratio is higher than the point where the maximum or the peak value appears. Furthermore, it has been confirmed that the gradient of the spool load curve in the above-mentioned region of the stroke ratio increases as the stroke ratio becomes greater.

As explained before, the solid-line curve O in FIG. 24 represents the change of the spool load obtained when the compression ratio is 7. It will be understood that this curve has a greater gradient than the spool load curve P in FIG. 24 which represents the characteristic obtained when the compression ratio is 6. It will also be seen that both the solid-line curves O and P have greater gradients than that of the spool load characteristic curve obtained when the compression ratio is 5.

Figure 26:
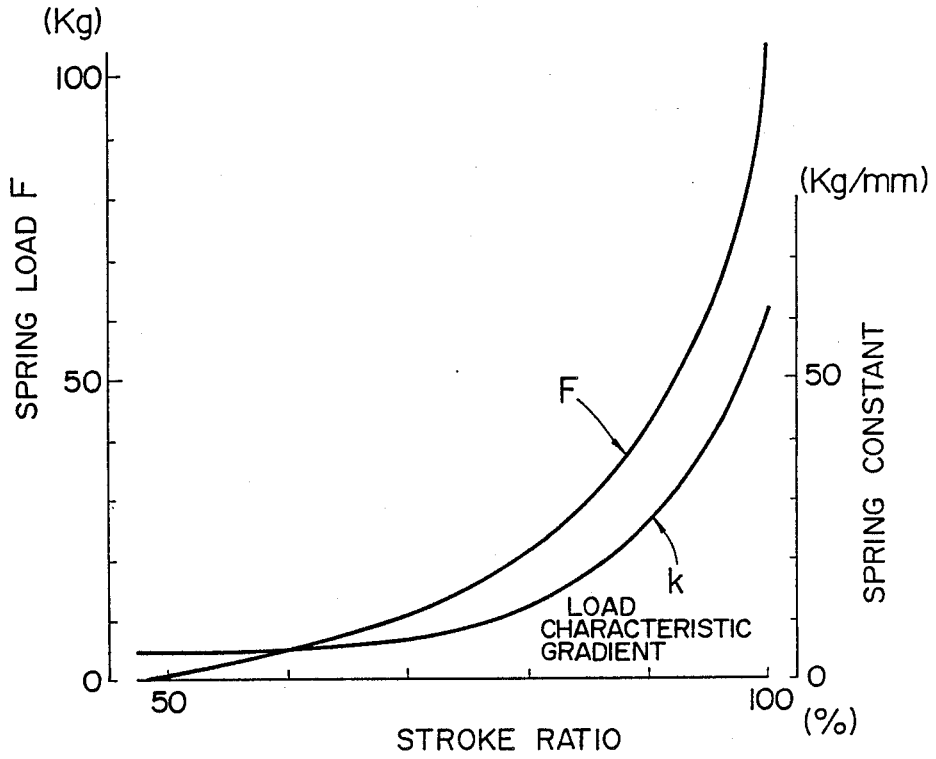
FIG. 26 is an illustration of the spring constant of the spring means of the type shown in FIG. 16.

FIG. 24 shows, by way of examples, gradients of characteristic curves obtained in three cases; namely, when the compression ratios are 7, 4 and 2. Actually, however, the compression ratio varies without discontinuity. Points of the greatest gradient values were measured for numerous compression ratio values and were plotted in relation to the stroke ratios (axis of abscissa) at which such maximum gradients are obtained, whereby a solid-line curve F as shown in FIG. 26 was obtained.

The problems or shortcomings described hereinabove can be overcome by a different embodiment of the present invention which employs auxiliary loading means capable of applying a load to the spool in such a manner as to suppress the movement of the spool towards the maximum-displacement end.

In this embodiment, a loading means having a non-linear loading characteristic is used as the auxiliary loading means. Namely, the loading characteristic of the auxiliary loading means is determined such that the auxiliary loading means provides a greater load when the spool is positioned closer to the maximum displacement position than when the same is located closer to the small-displacement position.

This auxiliary loading means assures a relationship between the spool stroke and the thrust load required for urging the spool, which is continuously varied without being accompanied by generation of negative gradient in the characteristic curve. In consequence, this embodiment enables the displacement of the compressor to be varied continuously by changing the load applied to the spool.

Figure 16:
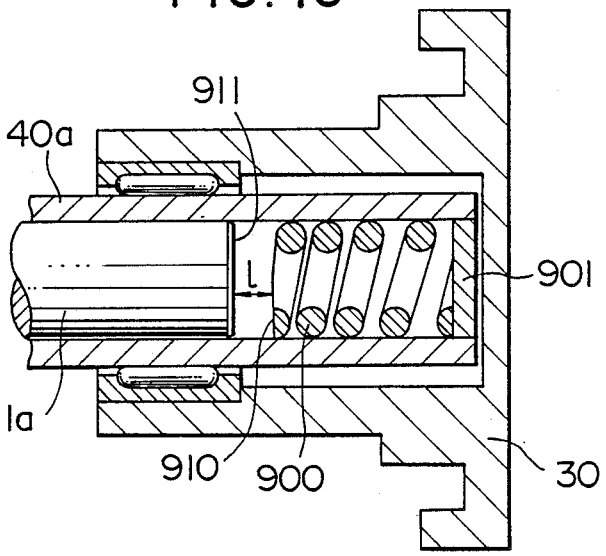
FIG. 16 is a sectional view of a spring means used in a compressor embodying the present invention.

This embodiment, which is considered as being an improvement in the embodiment of FIG. 12, employs a spool member 30 and associated parts which are shown in FIG. 16 in section.

A retainer plate 901 is disposed on the rear end of a slide portion 40*a*, and a spring means 900 as an auxiliary loading means is disposed to act between the retainer plate 901 and the rear end of the shaft 1*a*. The characteristic of the spring means 900 has been determined taking into consideration the results of the issues discussed in connection with FIGS. 18 to 26. Thus, the spring means 900 has such a non-linear spring constant characteristic that the spring constant K progressively increases in accordance with an increase in the stroke ration.

FIG. 16 shows the state in which the spool 30 has been fully displaced to the left as viewed in FIG. 12, i.e., the state in which the displacement of the compressor is minimized.

As will be seen from FIG. 16, when the spool 30 has been displaced to the position corresponding to the minimum displacement of the compressor, a predetermined gap l is left between one end 910 of the spring means 900 and the rear end 911 of the shaft 1*a*. Therefore, when the spool 30 is moved towards the minimum displacement end, the spring means 900 does not produce any urging force when the amount of movement of the spool is smaller than a predetermined value. Referring again to FIG. 26, the spring load F starts to progressively increase when the stroke ratio of the spool is increased beyond 50%. This spool position is the position where the end 910 of the spring means 900 is brought into contact with the rear end 911 of the shaft la. As will be understood from FIG. 26, the spring load F in this embodiment increases in a non-linear manner substantially in conformity with the gradient of the change of the curve K representing the spring constant.

In this embodiment, the spring means 900 has such a characteristic that the spring load F produced by this means substantially corresponds to the gradient of the load curve K, so that the spool 30 is allowed to be moved always in accordance with a change in the internal pressure of the control pressure chamber 200, regardless of the compression ratio. In other words, the undesirable negative gradient of the spool load-spool stroke curve, such as those of curves $M_1$ and $K_1$ in FIG. 25, which is observed when a return spring 900 having a linear characteristic is used, can be eliminated in this embodiment.

Figure 27:
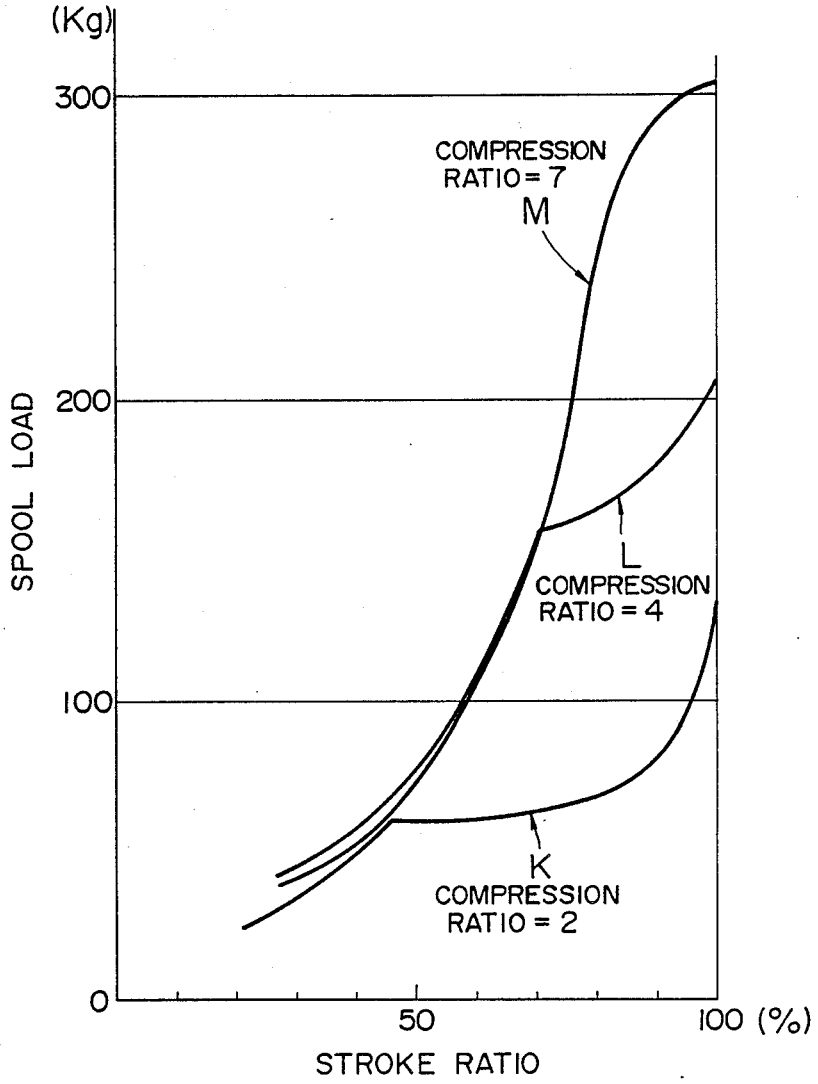
FIG. 27 is an illustration of the relationship between the spool stroke ratio and the load on the spool as obtained when a spring means having a non-linear characteristic is used as the auxiliary loading means.

FIG. 27 shows the relationship between the spool stroke ratio and the spool load observed in a compressor which employs the spring means having non-linear characteristic described in connection with FIG. 26. As will be clearly understood from FIG. 27, the spool load required for displacing the spool is increased in a simple manner as the stroke ratio increases, regardless of the compression ratio. Therefore, the compressor of this embodiment enables the spool 30 to be displaced to the right as viewed in FIG. 12 without fail in accordance with a rise in the internal pressure of the control pressure chamber 200, so that the displacement of the compressor can be precisely and definitely controlled by increasing or decreasing the pressure in the control pressure chamber 200 by means of the control valve.

The embodiment described with reference to FIG. 16 is only a preferred one and may be varied or modified in various manners.

Figure 28:
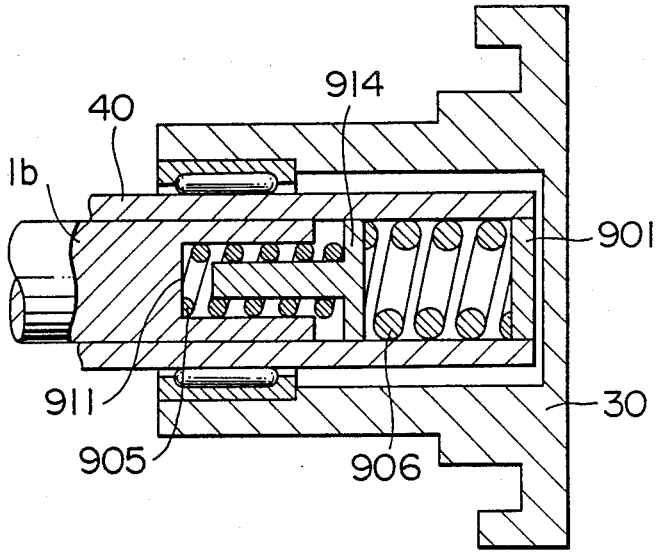
FIG. 28 is a sectional view of a different example of the auxiliary loading means used in the variable displacement swash-plate type compressor of the present invention.

For instance, though the spring 900 serving as the auxiliary loading means is a single spring member having a non-linear spring characteristic, the non-linear spring characteristic of the spring means 900 may be realized by a pair of springs 905 and 906 arranged in series and having different spring characteristics. Such a modification is shown in FIG. 28. The first spring 905 is retained at its one end by the rear end 911 of the shaft **1*b*, while the other end is retained by a spring retainer 914 which is disposed in the slide 40. The second spring 906 has one end retained by the spring retainer 914 while the other end of this spring 906 acts on the retainer plate 901**.

Figure 29:
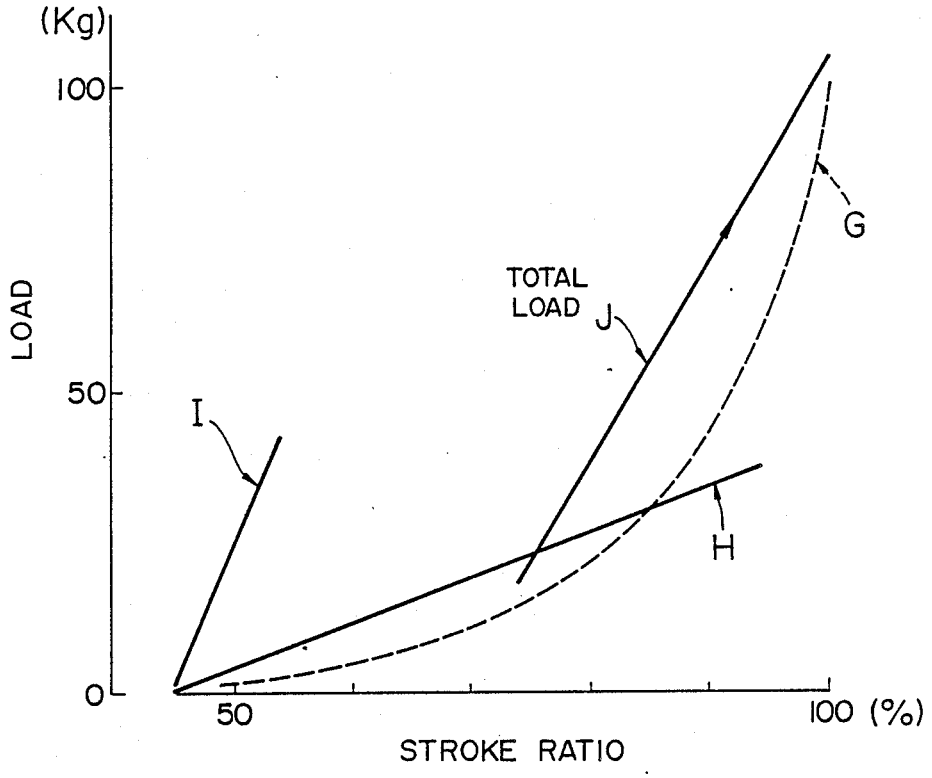
FIG. 29 is an illustration of the spring characteristic of the auxiliary loading means shown in FIG. 28.

The spring means composed of the pair of springs 905 and 906 exhibit a composite spring constant as shown in FIG. 29. In this Figure, a solid-line curve H represents the spring constant of the first spring 905, while a solid-line I represents the spring constant of the second spring 906. The composite spring constant composed of the spring constants of both springs is shown by a solid-line curve J in FIG. 29. A broken-line curve G in FIG. 29 shows the spring constant of the non-linear spring means explained before in connection with FIG. 16. As will be understood from FIG. 29, the spring means composed of the pair of springs 905 and 906 arranged in series provides a non-linear characteristic similar to that offered by the embodiment shown in FIG. 16, thus ensuring precise and stable control of the spool.

The serial arrangement of a pair of springs as shown in FIG. 28 offers the following advantage: Namely, the springs 905 and 906 are always held in engagement with the shaft lb, spring retainer 914 and the retainer plate 901, regardless of a change in the position of the spool 30, so that these springs 905 and 906 are prevented from rotating freely within the slide 40. In the embodiment shown in FIG. 16, a gap ( is formed between the spring 900 and the rear end 911 of the shaft when the spool is in a region corresponding to small displacement of the compressor. The spring 900, therefore, tends to rotate within the slider 40. Such a rotation of the spring 900 may cause a delicate change in the position of contact of the spring, resulting in a slight change in the spring characteristic. In the modification shown in FIG. 28, since the springs 905 and 906 are always held in contact with the respective retainers, no gap such as the gap l in the arrangement of FIG. 16 does not exist. The springs 905 and 906, therefore, are effectively prevented from rotating within the side 40. The modification shown in FIG. 28, therefore, the spring load produced by the springs 905 and 906 can be definitely determined.

Figure 30:
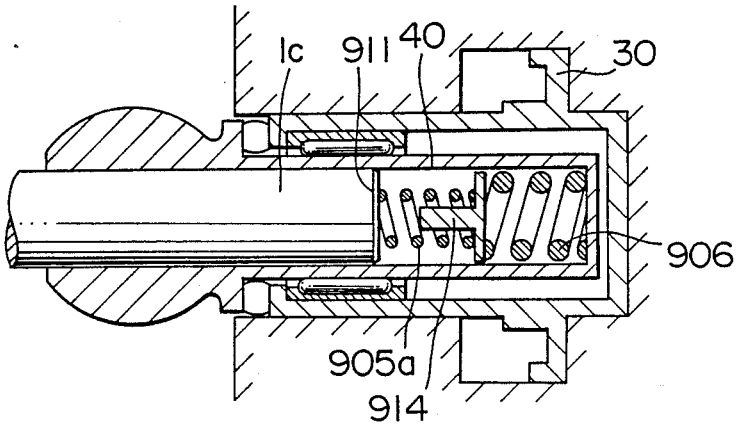
FIGS. 30 to 32 are sectional views of different examples of the auxiliary loading means incorporated in the variable displacement swash-plate type compressor of the present invention.

FIG. 30 shows a different modification of the arrangement shown in FIG. 28. In this modification, any retaining groove is not formed in the rear end 911 of the shaft **1*c*. Thus, the end of the first spring 905*a* merely contacts the flat surface on the rear end 911** of the shaft.

Figure 31:
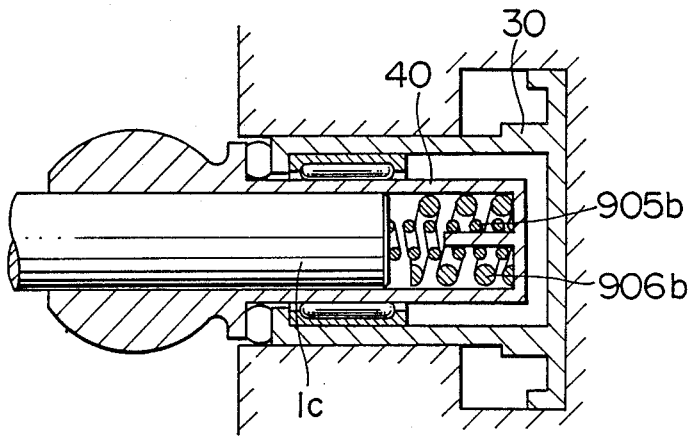

FIG. 31 shows a further modification in which the first spring **905*b* is disposed coaxially with and extends partly in the second spring 906*b*. These springs 905*b* and 906*b* in cooperation provide a non-linear spring constant characteristic as in the case of the arrangement shown in FIG. 28**.

Figure 32:
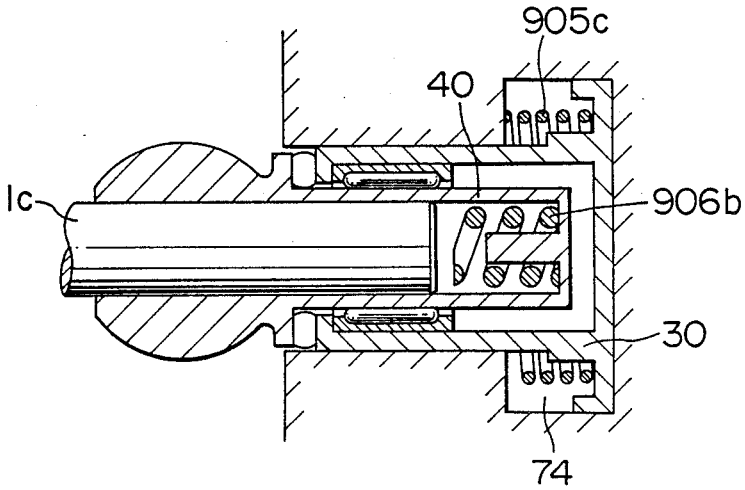

It is also to be understood that the springs **905*b* and 906*b* need not always be mounted in the slide 40. For instance, FIG. 32 shows an alternative arrangement in which the first spring 905*c* is disposed in the suction chamber 74**.

What is claimed is:

1. A variable displacement swash-plate type compressor comprising:

a cylinder block having cylinder chambers formed therein;

a shaft rotatably extending through and rotatably supported by said cylinder block;

a swash plate rockably connected to said shaft and rotatable together with said shaft;

pistons slidably received in said cylinder chambers and capable of reciprocally moving in said cylinder chambers in response to rocking motions of said swash plate;

working chambers defined between both ends of said pistons and adjacent walls of said cylinder chambers and capable of sucking and discharging a fluid into and out therefrom;

a control pressure chamber;

controlling means responsive to a pressure in said control pressure chamber to vary the angle of tilt of said swash plate and shift the center of said swash plate along the axis of said shaft such that a top dead point of one end of each piston is substantially constant; and a control valve for controlling a signal pressure supplied to said control pressure chamber;

wherein said control valve includes:

a first pressure introduction passage for a low pressure;

a second pressure introduction passage for a high pressure;

a signal pressure passage communicating with said control pressure chamber;

a control valve member operative to control the pressure to be introduced into said signal pressure passage between a first pressure level related to the low pressure and a second pressure level related to the high pressure;

a diaphragm capable of deflecting in accordance with a change in a pressure related to the low pressure;

means for transmitting the deflection of said diaphragm to said control valve member; and solenoid means operative to vary a deflecting force applied to said diaphragm.

2. A variable displacement swash-plate type compressor comprising:

a cylinder block having cylinder chambers formed therein;

a shaft rotatably extending through and rotatably supported by said cylinder block;

a swash plate rockably connected to said shaft and rotatable together with said shaft;

pistons slidably received in said cylinder chambers and capable of reciprocally moving in said cylinder chambers in response to rocking motions of said swash plate;

working chambers defined between both ends of said pistons and adjacent walls of said cylinder chambers and capable of sucking and discharging a fluid into and out therefrom;

supporting means disposed coaxially with said shaft and rockably supporting the center of said swash plate;

a spool for causing said supporting means to move in the axial direction of said shaft;

a control pressure chamber formed on the side of said spool opposite to said supporting means and capable of urging said spool in accordance with a pressure established therein; and a control valve for controlling a signal pressure supplied to said control pressure chamber;

wherein said control valve includes: a low-pressure introduction passage communicating with a low-pressure portion of said compressor; a high-pressure introduction passage communicating with a high-pressure portion of said compressor; a signal pressure passage communicating with said control pressure chamber; a control valve member capable of controlling the pressure to be introduced into said signal pressure passage between the level of a low pressure introduced through said lowpressure introduction passage and a high pressure introduced through said high-pressure introduction passage; a diaphragm capable of deflecting in accordance with a change in the pressure in a low-pressure side of said compressor; connecting means for transmitting the deflection of said diaphragm to said control valve member; and solenoid means disposed on the side of said diaphragm opposite to said connecting means and capable of changing, in response to a change in an electromagnetic force, the deflecting force applied to said diaphragm.

3. A variable displacement swash-plate type compressor according to claim 2, wherein said control valve is capable of switching said signal pressure between the level of the suction pressure and the level of the discharge pressure of said compressor, so that, when said control valve allows said discharge pressure to be introduced into said control pressure chamber, said spool operates said supporting means in a direction to increase the tilting angle of said swash plate, whereas, when said control valve allows said suction pressure to be introduced into said control pressure chamber, said supporting means and said spool are displaced in a direction to reduce the tilting angle of said swash plate, and wherein, in the working chambers formed on one side of said pistons, said pistons are allowed to perform stroking so as to cause suction, compression and discharge of said fluid regardless of a change in the tilting angle of said swash plate, whereas, in the working chambers formed on the other side of said pistons, dead volumes are produced in accordance with changes in the tilting angle of said swash plate.

4. A variable displacement swash-plate type compressor according to claim 2, wherein said control valve is so constructed that said high-pressure introduction passage and said signal pressure passage are communicated with each other through an orifice, while said control valve member is disposed to selectively allow said low-pressure introduction passage and said signal pressure, passage to be communicated with each other.

5. A variable displacement swash-plate type compressor according to claim 2, wherein said control valve is so constructed that said low-pressure introduction passage and said signal pressure passage are always communicated with each other, while said control valve member is disposed to selectively allow said high-pressure introduction passage and said signal pressure passage to be communicated with each other.

6. A variable displacement swash-plate type compressor according to claim 2, wherein said control valve further includes a biasing spring means provided to urge said diaphragm towards said connecting means.

7. A variable displacement swash-plate type compressor according to claim 6, wherein said solenoid means is arranged such that it applies, when energized, to said diaphragm a force acting in the same direction as the force of said biasing spring.

8. A variable displacement swash-plate type compressor according to claim 6, wherein said solenoid means is arranged such that it applies, when energized, to said diaphragm a force acting in the direction counter to the direction of the force of said biasing spring.

9. A variable displacement swash-plate type compressor according to claim 2, wherein said control valve member is a ball valve capable of establishing and breaking a communication between said low-pressure introduction passage and said signal passage and a communication between said high-pressure introduction passage and said signal pressure passage.

10. A variable displacement swash-plate type compressor according to claim 9, wherein said control valve further includes a retainer member provided on the side of said control valve member opposite to said connecting means, and a supporting spring provided behind said retainer member, whereby said retainer member is urged by said supporting spring into contact with said control valve member for thereby retaining said control valve member.

11. A variable displacement swash-plate type compressor according to claim 2, wherein said solenoid means is capable of changing the electromagnetic force in accordance with a signal from a controller.

12. A variable displacement swash-plate type compressor according to claim 11, wherein said controller produces said electric signal in accordance with a signal derived from a sensor means capable of sensing the level of a thermal load applied to a refrigeration cycle.

13. A variable displacement swash-plate type compressor according to claim 12, wherein said sensor means includes a sensor capable of sensing the temperature of air at an air outlet of an evaporator of said refrigeration system and a sensor for sensing a room air temperature.

14. A variable displacement swash-plate type compressor according to claim 12, wherein said sensor means includes an accelerator sensor and said controller selectively delivers said electric signal to said solenoid means in accordance with a signal from said accelerator sensor.

15. A variable displacement swash-plate type compressor according to claim 2, further comprising auxiliary loading means for suppressing the movement of said spool in a direction for maximizing the displacement of said compressor, the suppressing effect produced by said auxiliary loading means being increased nonlinearly as said spool approaches the position for maximizing the displacement of said compressor.

16. A variable displacement swash-plate type compressor according to claim 15, wherein said auxiliary loading means includes a spring means which is retained at its both ends and which has a non-linear spring characteristic, said spring means being arranged such that the force for suppressing the movement of said spool is transmitted from one end of said spring means.

17. A variable displacement swash-plate type compressor according to claim 15, wherein said auxiliary loading means includes a plurality of spring members arranged in series.

* * * * *